US007774942B2

(12) United States Patent
Schmidt

(10) Patent No.: US 7,774,942 B2
(45) Date of Patent: Aug. 17, 2010

(54) UTILITY KNIFE

(75) Inventor: G. Gerry Schmidt, Newport Beach, CA (US)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 738 days.

(21) Appl. No.: 11/539,839

(22) Filed: Oct. 9, 2006

(65) Prior Publication Data

US 2008/0083119 A1 Apr. 10, 2008

(51) Int. Cl.
*B26B 1/08* (2006.01)

(52) U.S. Cl. ..... 30/162; 30/286; 30/342; 30/335

(58) Field of Classification Search ..... 30/2, 30/162, 342, 143, 286, 288
See application file for complete search history.

(56) References Cited

U.S. PATENT DOCUMENTS

| | | | | |
|---|---|---|---|---|
| 1,452,893 | A | | 4/1923 | Porth |
| 1,507,043 | A | | 9/1924 | Blow |
| 3,107,426 | A | | 10/1963 | Robinson, Jr. |
| 3,641,667 | A | | 2/1972 | Leopoldi |
| 3,706,332 | A | | 12/1972 | George |
| 3,787,973 | A | | 1/1974 | Beisch et al. |
| 3,922,785 | A | | 12/1975 | Fushiya |
| 3,943,627 | A | | 3/1976 | Stanley, Jr. |
| 4,028,758 | A | | 6/1977 | O'Connor |
| 4,086,698 | A | * | 5/1978 | Sparks ..... 30/2 |
| 4,091,537 | A | | 5/1978 | Stevenson, Jr. |
| 4,257,162 | A | | 3/1981 | Pardon |
| 4,548,114 | A | | 10/1985 | Sauer |
| 4,570,840 | A | | 2/1986 | Bull |
| 4,621,426 | A | | 11/1986 | Shivers |
| 4,672,746 | A | | 6/1987 | Zeilenga |
| 4,683,656 | A | | 8/1987 | Peyrot et al. |
| 4,693,008 | A | | 9/1987 | Velie |
| 4,713,885 | A | | 12/1987 | Keklak et al. |
| 4,757,612 | A | | 7/1988 | Peyrot |
| 4,805,304 | A | | 2/1989 | Knoop |

(Continued)

FOREIGN PATENT DOCUMENTS

DE 26 23 490 12/1977

(Continued)

OTHER PUBLICATIONS

Selt Retracting Knife has 3-button design for user safety. Pacific Hany Cutter, Inc. Press Release regarding RZ3 Saefety Utility Knife [online]. ThomasNet NEWS, Oct. 12, 2005 [retreived on Dec. 14, 2009]. Retreived from the Internet:<URL:http://news.thomasnet.com/fullstory/468031>.*

(Continued)

*Primary Examiner*—Jason Daniel Prone
*Assistant Examiner*—Jennifer Swinney
(74) *Attorney, Agent, or Firm*—Henricks, Slavin & Holmes LLP

(57) ABSTRACT

A utility knife includes a handle, a blade assembly secured to the handle, a blade cover mechanically coupled to the handle facilitating manipulability of the blade cover to an extended position over the blade assembly, and a slider that is repositionable along the handle to release the blade cover from the extended position, the slider being pivotally coupled to the blade assembly.

39 Claims, 14 Drawing Sheets

U.S. PATENT DOCUMENTS

| | | | | |
|---|---|---|---|---|
| 4,949,458 | A | 8/1990 | Davis et al. | |
| 4,980,977 | A | 1/1991 | Matin et al. | |
| 4,987,682 | A * | 1/1991 | Minnick | 30/295 |
| 5,071,426 | A | 12/1991 | Dolgin et al. | |
| 5,101,564 | A | 4/1992 | Melter | |
| 5,133,730 | A | 7/1992 | Biro et al. | |
| 5,152,751 | A | 10/1992 | Kozlowski | |
| 5,181,447 | A | 1/1993 | Hewitt | |
| 5,203,085 | A | 4/1993 | Berns | |
| 5,241,750 | A | 9/1993 | Chomiak | |
| 5,250,064 | A | 10/1993 | Schneider | |
| 5,287,779 | A | 2/1994 | Metzger, Jr. | |
| 5,303,474 | A | 4/1994 | Keklak et al. | |
| 5,312,354 | A | 5/1994 | Allen et al. | |
| 5,330,494 | A | 7/1994 | van der Westhuizen et al. | |
| 5,404,645 | A | 4/1995 | Janser | |
| 5,490,331 | A | 2/1996 | Gold | |
| 5,498,244 | A | 3/1996 | Eck | |
| 5,502,896 | A | 4/1996 | Chen | |
| 5,522,135 | A | 6/1996 | Votolato | |
| 5,577,600 | A | 11/1996 | Schoene et al. | |
| 5,581,890 | A * | 12/1996 | Schmidt | 30/162 |
| 5,620,454 | A | 4/1997 | Pierce et al. | |
| 5,662,669 | A | 9/1997 | Abidin et al. | |
| 5,697,157 | A | 12/1997 | Votolato | |
| 5,711,077 | A | 1/1998 | Schulz et al. | |
| 5,715,605 | A | 2/1998 | Nadeau | |
| 5,752,421 | A | 5/1998 | Chang | |
| 5,782,852 | A | 7/1998 | Foggia et al. | |
| 5,791,048 | A | 8/1998 | Bodnar et al. | |
| 5,813,121 | A | 9/1998 | Gringer | |
| 5,878,501 | A * | 3/1999 | Owens et al. | 30/286 |
| 5,890,290 | A | 4/1999 | Davis | |
| 5,918,522 | A | 7/1999 | Benedict et al. | |
| 5,941,892 | A | 8/1999 | Cohn et al. | |
| 6,058,607 | A | 5/2000 | Gringer | |
| 6,070,326 | A | 6/2000 | Berns | |
| 6,178,640 | B1 | 1/2001 | Votolato | |
| 6,233,830 | B1 | 5/2001 | Lamond et al. | |
| 6,233,832 | B1 | 5/2001 | Berns | |
| 6,314,646 | B1 | 11/2001 | Schmidt | |
| D460,908 | S | 7/2002 | Sun | |
| 6,453,559 | B1 | 9/2002 | Marshall et al. | |
| 6,513,246 | B2 | 2/2003 | Ping | |
| 6,536,115 | B2 | 3/2003 | Tabbi et al. | |
| 6,543,140 | B1 * | 4/2003 | Davis | 30/2 |
| 6,560,873 | B1 * | 5/2003 | Ortner et al. | 30/2 |
| D475,910 | S | 6/2003 | Schmidt | |
| 6,578,266 | B2 | 6/2003 | Chomiak | |
| 6,578,460 | B2 | 6/2003 | Sartori | |
| 6,637,112 | B2 | 10/2003 | Davis | |
| 6,643,936 | B2 | 11/2003 | Carlson et al. | |
| 6,718,637 | B1 | 4/2004 | Ortner et al. | |
| 6,718,640 | B1 | 4/2004 | John | |
| 6,785,966 | B2 | 9/2004 | Berns | |
| 6,813,833 | B2 | 11/2004 | Saunders et al. | |
| 6,892,456 | B2 | 5/2005 | Yu Chen | |
| 6,957,491 | B2 | 10/2005 | Van Deursen et al. | |
| 6,983,541 | B2 | 1/2006 | Kaczorowski | |
| 7,024,772 | B1 | 4/2006 | Shaver et al. | |
| 7,024,773 | B2 | 4/2006 | Jennings | |
| 7,055,417 | B1 | 6/2006 | Gass | |
| 7,082,688 | B2 * | 8/2006 | Votolato | 30/293 |
| 7,096,586 | B2 | 8/2006 | Carpenter et al. | |
| D529,780 | S | 10/2006 | Davis | |
| D559,072 | S * | 1/2008 | Fraga | D8/99 |
| 7,316,070 | B2 | 1/2008 | Green | |
| 7,322,110 | B2 | 1/2008 | Hernandez et al. | |
| 7,356,928 | B2 * | 4/2008 | Votolato | 30/2 |
| 7,380,341 | B2 | 6/2008 | Ping | |
| 7,475,480 | B2 | 1/2009 | Votolato | |
| 7,509,742 | B2 * | 3/2009 | Votolato | 30/151 |
| 7,520,059 | B2 | 4/2009 | Ranieri et al. | |
| 2002/0124412 | A1 | 9/2002 | Votolato | |
| 2002/0124418 | A1 | 9/2002 | Votolato | |
| 2003/0196331 | A1 | 10/2003 | Ho | |
| 2003/0229988 | A1 | 12/2003 | Jennings | |
| 2005/0193568 | A1 | 9/2005 | Peyrot et al. | |
| 2005/0223567 | A1 | 10/2005 | Cobb et al. | |
| 2006/0080842 | A1 | 4/2006 | Schmidt | |
| 2007/0011882 | A1 * | 1/2007 | Ping | 30/162 |
| 2007/0068003 | A1 * | 3/2007 | Schmidt | 30/162 |
| 2008/0000031 | A1 * | 1/2008 | Delneo et al. | 7/160 |

FOREIGN PATENT DOCUMENTS

| | | |
|---|---|---|
| DE | 8912929 | 2/1990 |
| EP | 0252711 B1 | 6/1991 |
| EP | 0633104 A1 | 1/1995 |
| EP | 0963819 B1 | 12/1999 |
| FR | 2552006 | 3/1985 |
| GB | 2050227 | 1/1981 |
| GB | 2232371 A | 12/1990 |
| WO | WO 94/04324 | 3/1994 |

OTHER PUBLICATIONS

U.S. Appl. No. 10/966,733 (complete file history through Appeal Docketing Notice mailed on Jul. 16, 2009).

U.S. Appl. No. 11/556,599 (complete file history through Non-Final Rejection mailed on Sep. 16, 2009).

Store Supply Safety Catalog. Pacific Handy Cutter, Inc., Dec. 2004. Pages showing RZ3 Safety Utility Knife (which is the subject of co-owned U.S. Appl. No. 10/966,733).

'Contact PHC Customer Service'. Web-page showing RZ3 Safety Utility Knife (which is the subject of co-owned U.S. Appl. No. 10/966,733) [online]. Pacific Handy Cutter, Inc., Mar. 8, 2005 [retrieved on Dec. 14, 2009]. Retrieved from the Internet: <URL: http://web.archive.org/web/20050308102139/www.razortools.com/contact.htm>.

New Products: Industrial/Retail Tools & Blades. Pacific Handy Cutter, Inc., Jul. 2005. Pages showing RZ3 Safety Utility Knife (which is the subject of co-owned U.S. Appl. No. 10/966,733).

'Self-Retracting Knife has 3-button design for user safety'. Pacific Handy Cutter, Inc. Press Release regarding RZ3 Safety Utility Knife (which is the subject of co-owned U.S. Appl. No. 10/966,733) [online]. ThomasNet NEWS, Oct. 12, 2005 [retrieved on Dec. 14, 2009]. Retrieved from the Internet: <URL: http://news.thomasnet.com/fullstory/468031>.

Response to Office Action, filed on Mar. 16, 2010, in Schmidt, U.S. Appl. No. 11/556,599, filed Nov. 3, 2006).

* cited by examiner 206
206
206
206
206
108

108

108

108
108

108

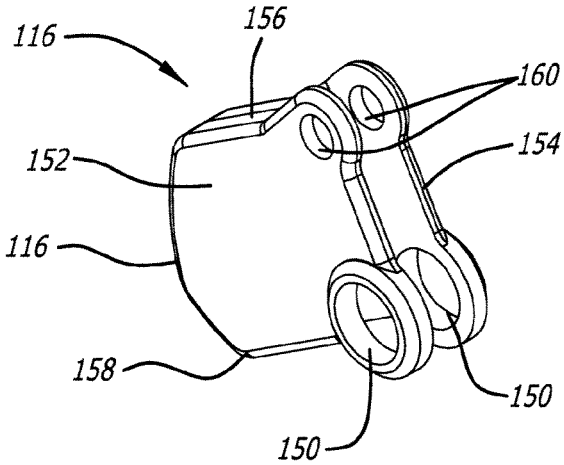
FIG. 7
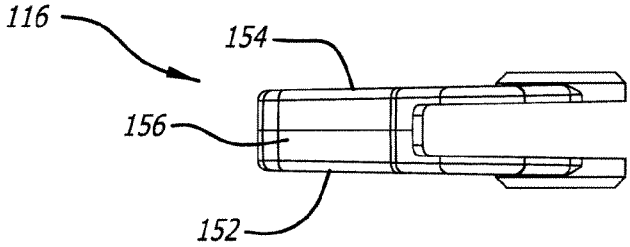
FIG. 7B
FIG. 7D
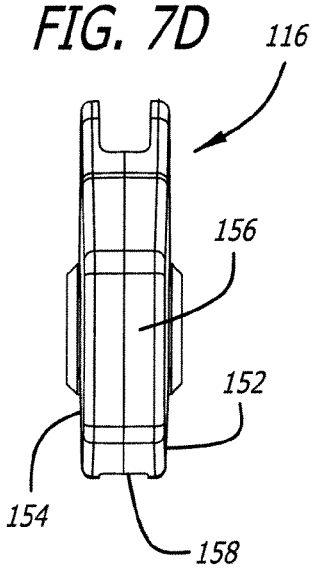
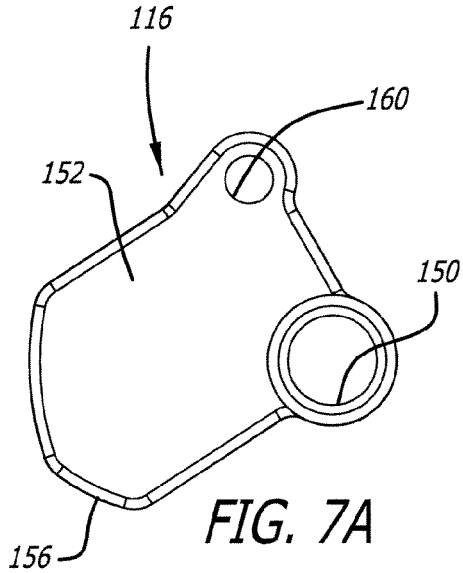
FIG. 7A
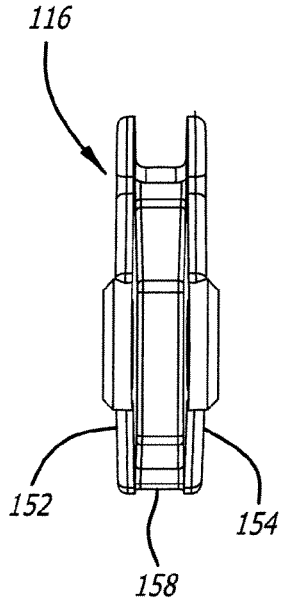
FIG. 7E
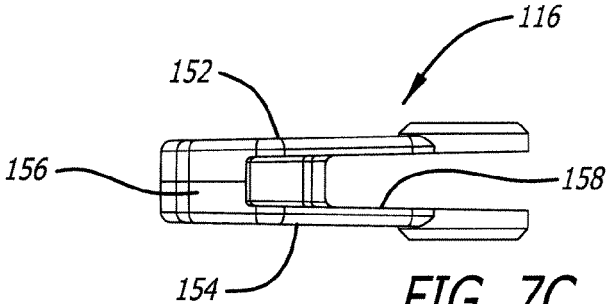
FIG. 7C FIG. 8
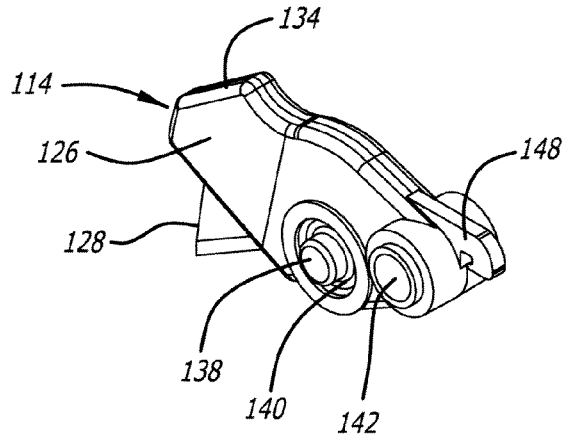
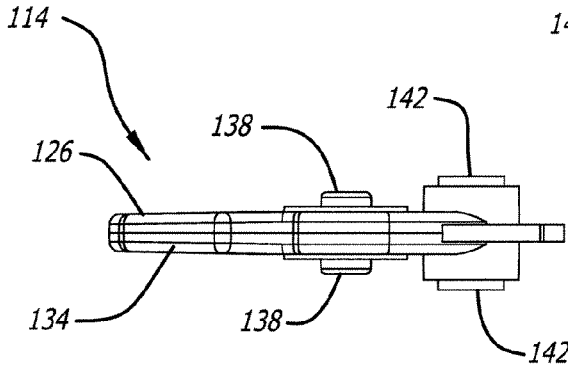
FIG. 8B
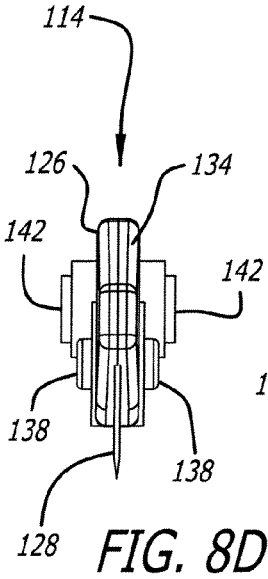
FIG. 8D
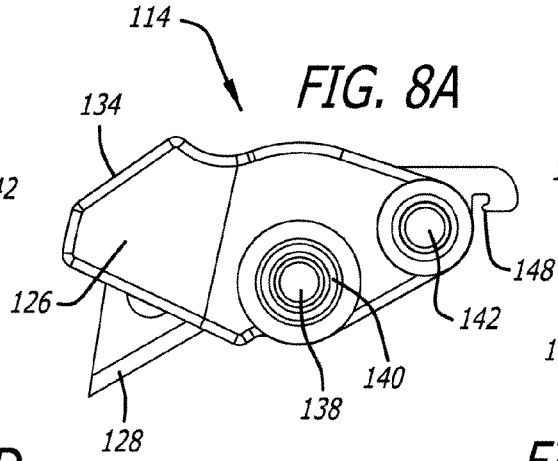
FIG. 8A
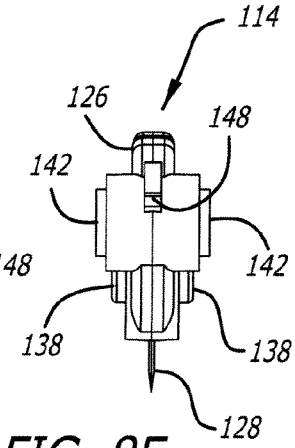
FIG. 8E
FIG. 8C
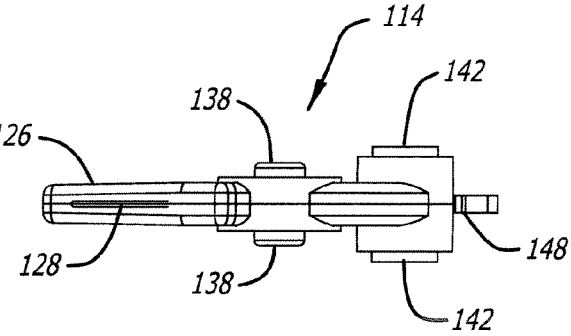

UTILITY KNIFE

CROSS-REFERENCE TO RELATED APPLICATIONS

This application is related to co-owned U.S. design patent application Ser. No. 29/248,176 entitled "Restaurant Knife" filed on Aug. 1, 2006.

TECHNICAL FIELD

The present invention relates generally to knives and, in particular, a utility knife with a safety mechanism for controlling the release of a blade cover from an extended position.

BACKGROUND ART

Various blades, knives, box cutters and the like (collectively, "tools") are known, some of which are provided with blade covers. Typically, such blade covers need to be removed or, if mechanically coupled to the tool, manipulated in position by the user in order to expose the blade for use. Proximity of the blade cover to the blade sometimes makes is hazardous for a user of the tool to remove or manipulate the position of the blade cover. Accordingly, it would be useful to be able to provide a utility knife or other tool with a safety mechanism for controlling the release of a blade cover from an extended position.

SUMMARY OF THE INVENTION

In an example embodiment, a utility knife includes a handle, a blade assembly secured to the handle, a blade cover mechanically coupled to the handle facilitating manipulability of the blade cover to an extended position over the blade assembly, and a slider that is repositionable along the handle to release the blade cover from the extended position, the slider being pivotally coupled to the blade assembly. In an example embodiment, the handle includes a base portion with a protrusion (e.g., shaped for functioning as a tape splitter). In an example embodiment, the blade cover is pivotally coupled to the blade assembly. In an example embodiment, the slider includes one or more buttons that extend through the handle, at least one of the buttons extending through a top side of the handle opposite a blade cutting edge of the blade assembly. In an example embodiment, the slider includes three buttons that extend through the handle. In an example embodiment, the utility knife further includes a mechanism for urging the blade cover toward the extended position. For example, the mechanism includes a spring. In an example embodiment, the utility knife further includes a push rod that is mechanically coupled to the blade cover, and a stop inside the handle; wherein the slider is configured to manipulate the push rod in relation to the stop. For example, the slider mechanism includes a lifter member that bears against the push rod when the slider is moved into a position that releases the blade cover. For example, the slider includes a return spring that imparts a force tending to urge the slider away from the position that releases the blade cover.

In an example embodiment, a utility knife includes a handle, a blade assembly secured to the handle, a blade cover mechanically coupled to the handle facilitating manipulability of the blade cover to an extended position over the blade assembly, a stop in the handle, a push rod that is mechanically coupled to the blade cover and configured such that the push rod is positioned adjacent to the stop when the blade cover is in the extended position, and a lifter member that is pivotally movable within the handle to engage with and reposition the push rod in relation to the stop such that the blade cover is released from the extended position. In an example embodiment, the handle includes a base portion with a protrusion (e.g., shaped for functioning as a tape splitter). In an example embodiment, the blade cover is pivotally coupled to blade assembly. In an example embodiment, the lifter member is pivotally coupled to the blade assembly. In an example embodiment, the push rod includes a safety tooth that fits within a recess in the handle when the blade cover is in the extended position and pressure is applied to the blade cover thereby preventing the lifter member from lifting the push rod. In an example embodiment, the push rod is entirely rigid. In an example embodiment, the utility knife further includes a spring connected between the blade assembly and the push rod. In an example embodiment, the utility knife further includes one or more buttons that are connected to the lifter member and repositionable along the handle to pivot the lifter member. For example, one of the buttons extends through a top side of the handle opposite a blade cutting edge of the blade assembly.

In an example embodiment, a utility knife includes a handle, a blade assembly secured to the handle, a blade cover mechanically coupled to the handle, a push rod inside the handle, a slider mechanism mechanically coupled to the push rod, the slider mechanism being movable in relation to the housing such that the push rod is allowed to move within the handle to facilitate locking the blade cover in an extended position over the blade assembly and unlocking the blade cover from the extended position, and a spring configured to urge the blade cover toward the extended position. In an example embodiment, the handle includes a base portion with a protrusion (e.g., shaped for functioning as a tape splitter). In an example embodiment, the push rod is entirely rigid. In an example embodiment, the spring is connected to the push rod. In an example embodiment, the spring is connected between the push rod and the blade assembly. In an example embodiment, the blade cover is pivotally connected to the blade assembly. In an example embodiment, the slider mechanism is pivotally connected to the blade assembly. In an example embodiment, the slider mechanism includes a lifter member for releasing the blade cover from the extended position by repositioning the push rod in relation to a portion of the handle. For example, the portion of the handle is a stop. In an example embodiment, the slider mechanism includes a return spring biased to urge the slider mechanism away from a slider position that releases the blade cover from the extended position. In an example embodiment, the slider mechanism includes one or more buttons that extend through the handle. For example, one of the buttons extends through a top side of the handle opposite a blade cutting edge of the blade assembly.

BRIEF DESCRIPTION OF THE DRAWINGS

FIG. 7 is a front perspective view of the blade cover shown in FIG. 3;

FIGS. 7A-7E are front, top, bottom, left side, and right side views, respectively, of the blade cover of FIG. 7;

FIG. 8 is a front perspective view of the blade assembly of FIG. 3;

FIGS. 8A-8E are front, top, bottom, left side, and right side views, respectively, of the blade assembly of FIG. 8;

DISCLOSURE OF INVENTION

Figure 1:
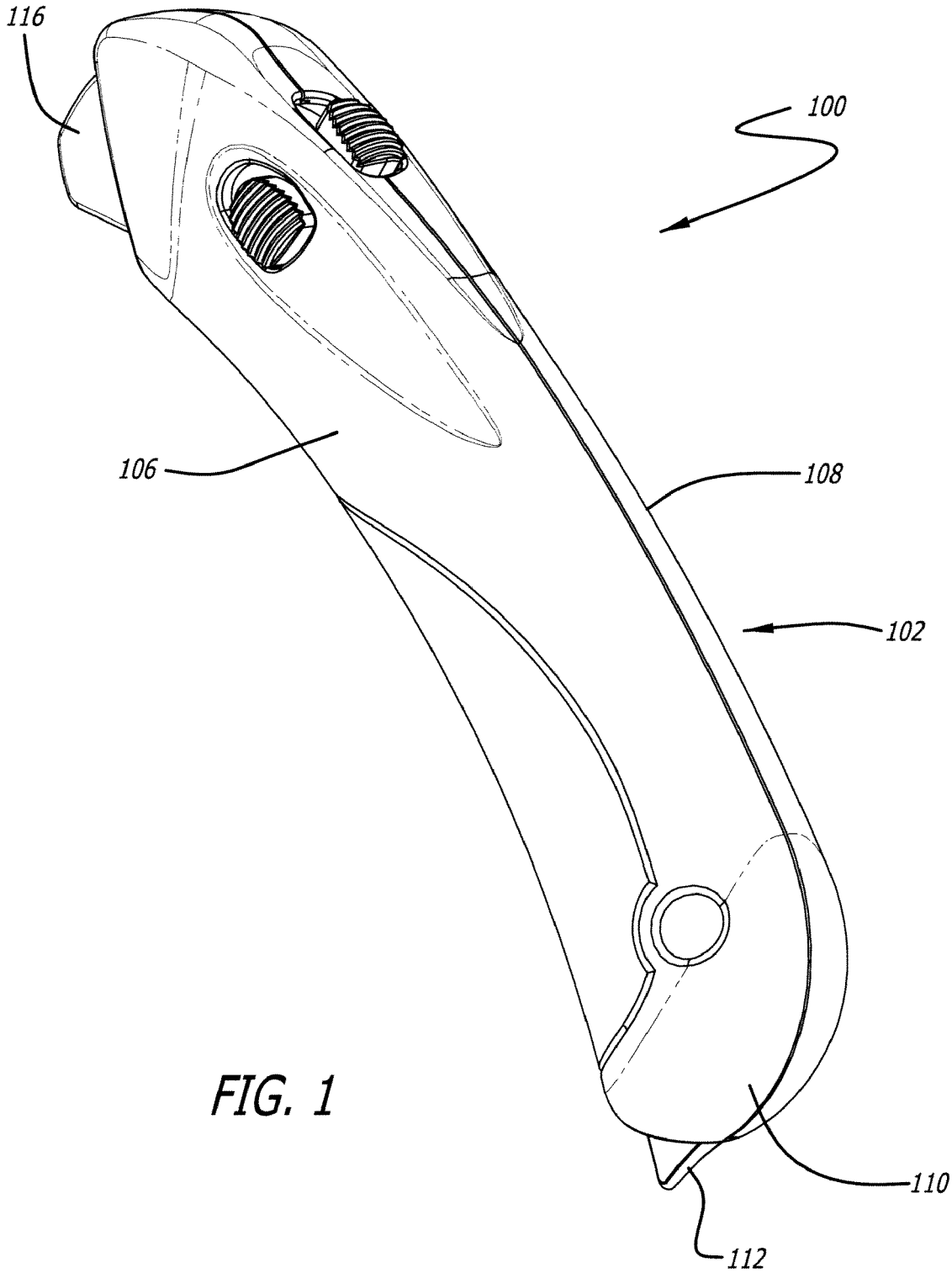
FIG. 1 is a front perspective view of an example embodiment of a utility knife.
Figure 2:
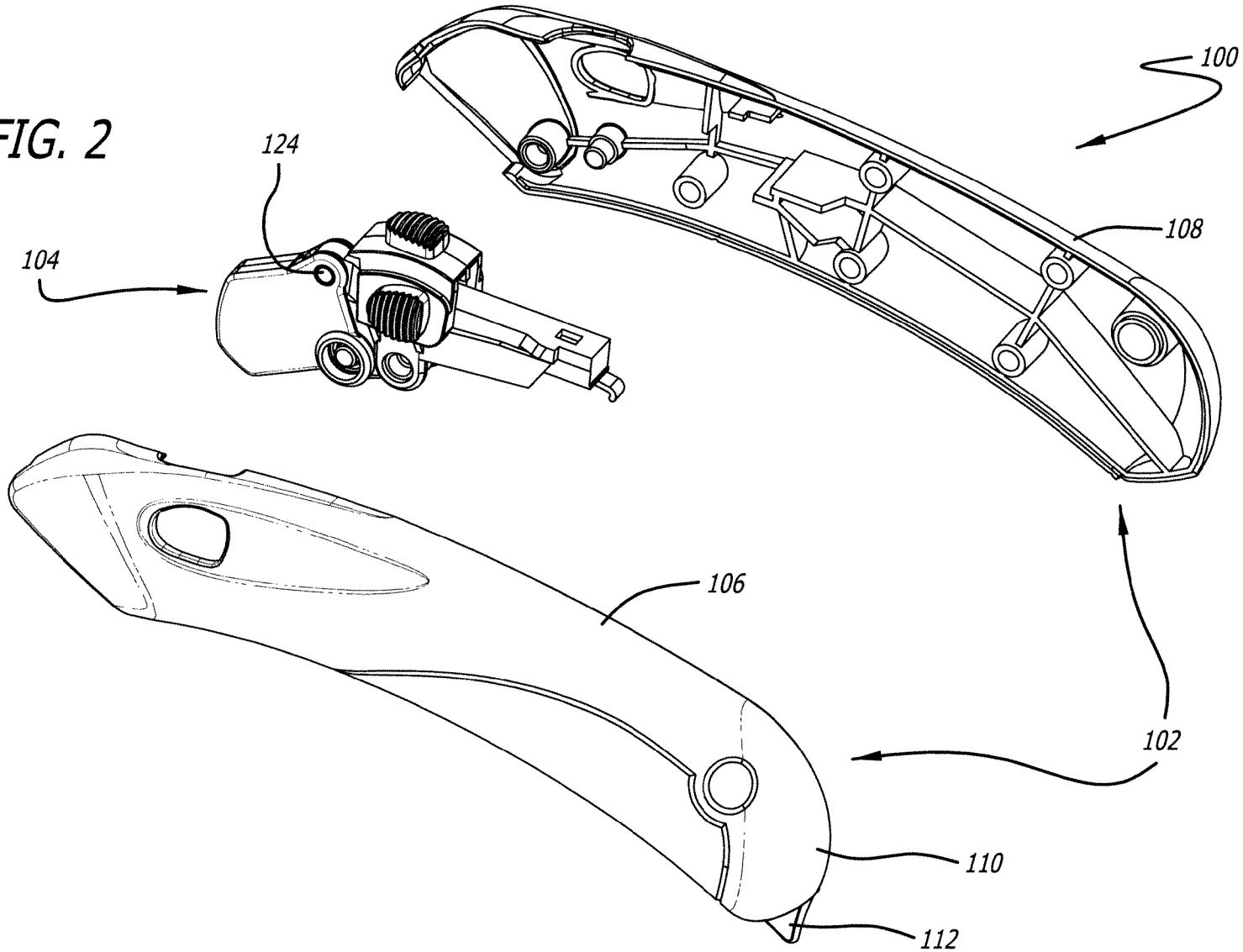
FIG. 2 is an exploded perspective view of the utility knife of FIG. 1, showing a blade subassembly thereof.

Referring to FIGS. 1 and 2, in an example embodiment, a utility knife 100 includes a handle 102 and a subassembly 104. In this example embodiment, the handle 102 includes a left side 106 and a right side 108 which, when attached together, secure the subassembly 104 inside the handle 102. In this example embodiment, the left side 106 includes a base portion 110 with a protrusion 112 (e.g., shaped as shown to function as a tape splitter). The positioning of the protrusion 112 on the base portion 110 as shown provides an ergonomic tool for splitting tape, or other wrappers and materials. Alternately, the handle 102 can be formed such that the protrusion 112 is provided on the right side 108, or on both the left side 106 and the right side 108.

Figure 3:
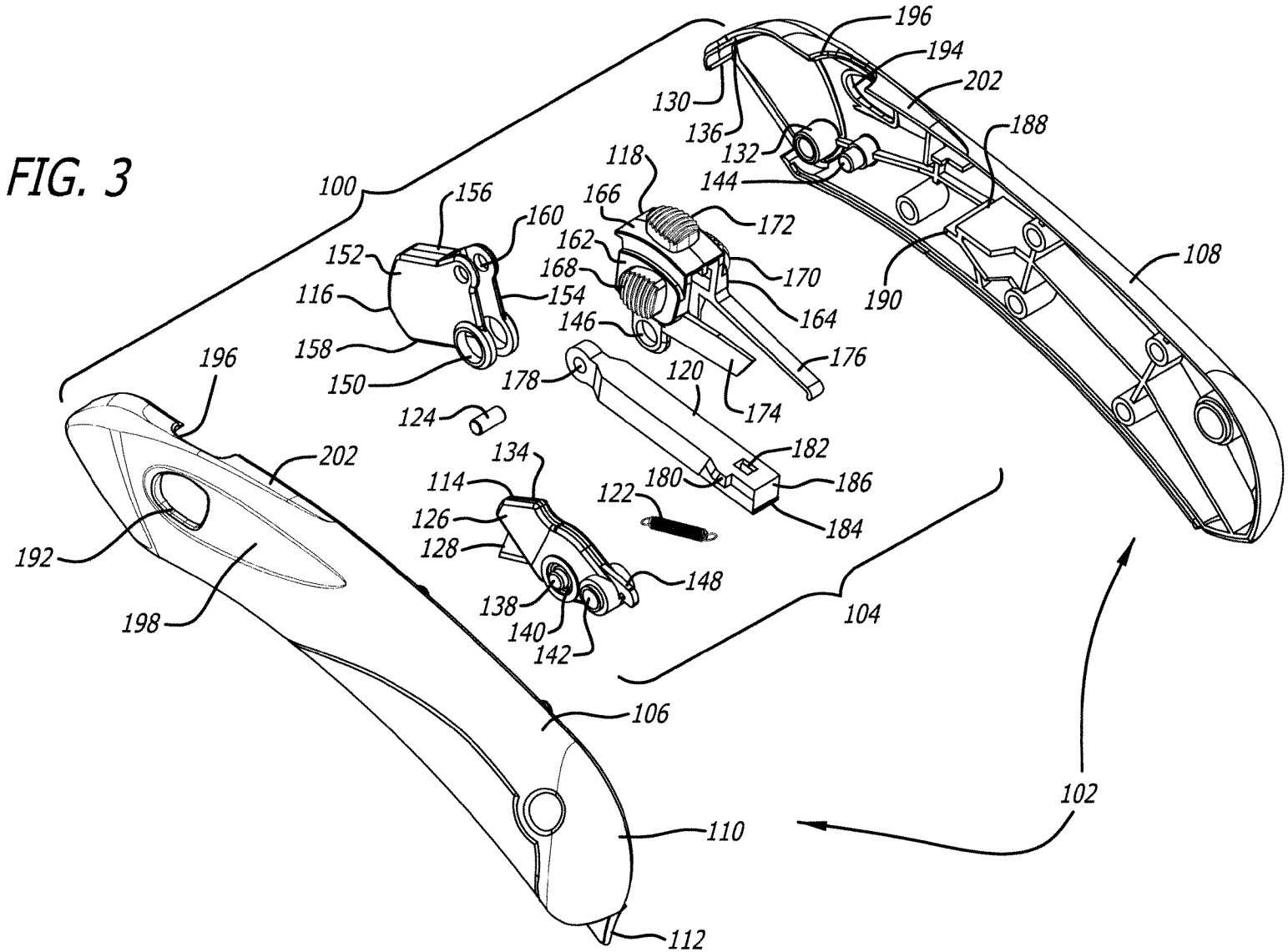
FIG. 3 is the view of FIG. 2, also showing the blade subassembly in exploded perspective.
Figure 4B:
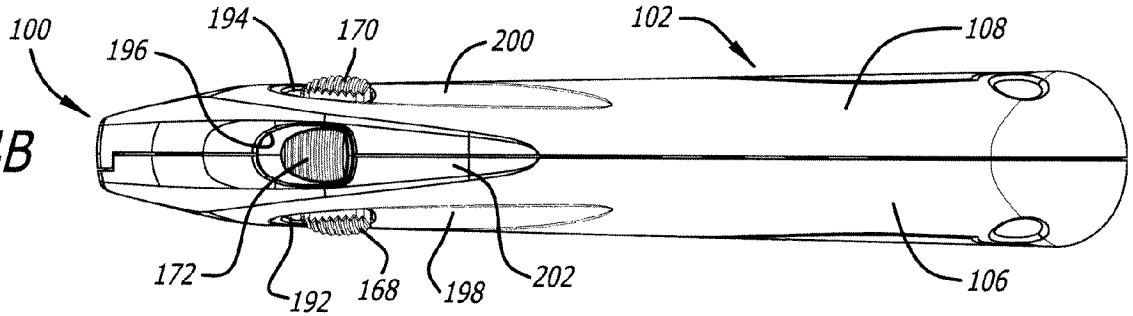
FIGS. 4A-4E are front, top, bottom, left side, and right side views, respectively, of the utility knife of FIG. 1.
Figure 4A:
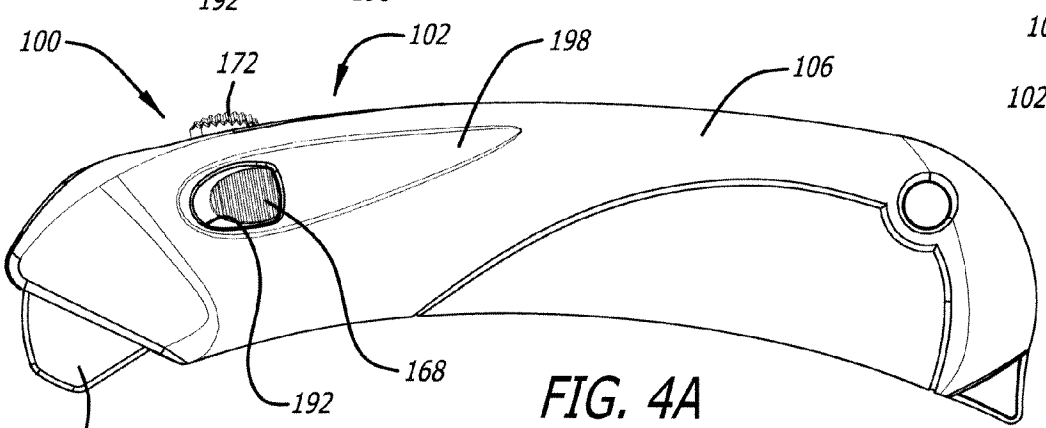
Figure 4E:
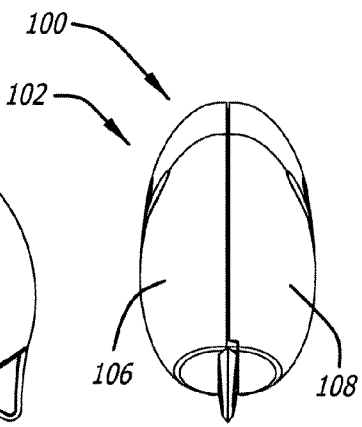
Figure 4C:
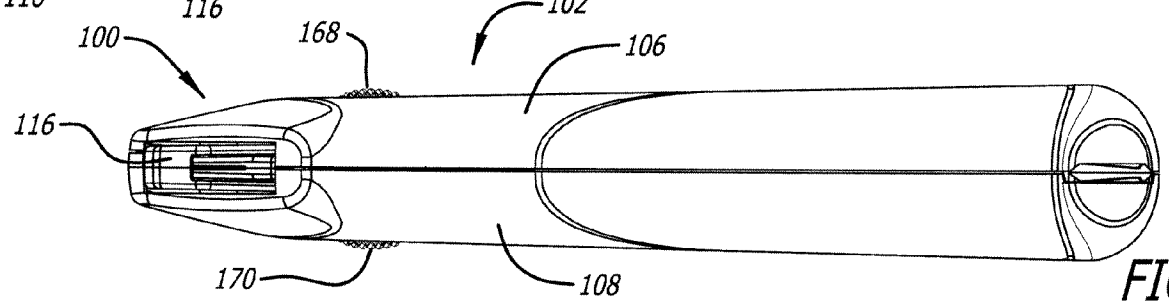
Figure 4D:
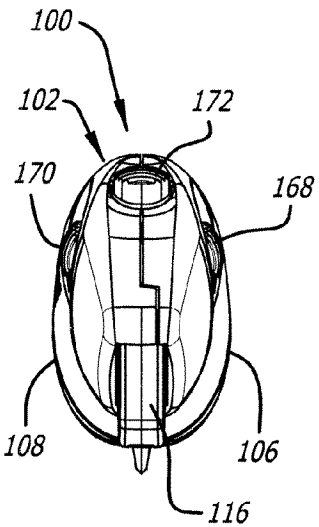
Figure 5E:
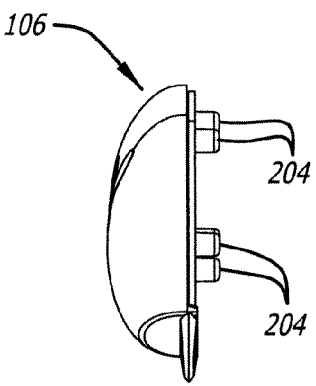
FIGS. 5A-5F are front, top, bottom, left side, right side, and back views, respectively, of the left side of the handle of FIG. 1.
Figure 5F:
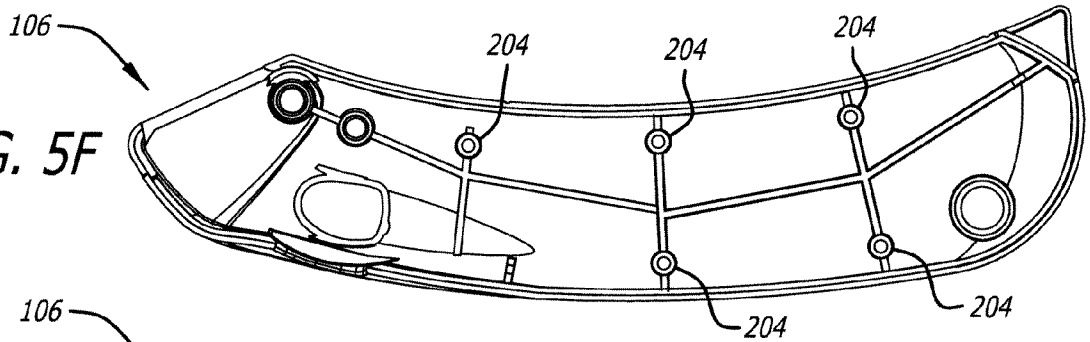
Figure 5B:
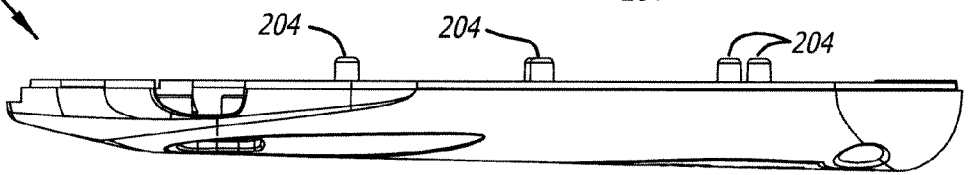
Figure 5A:
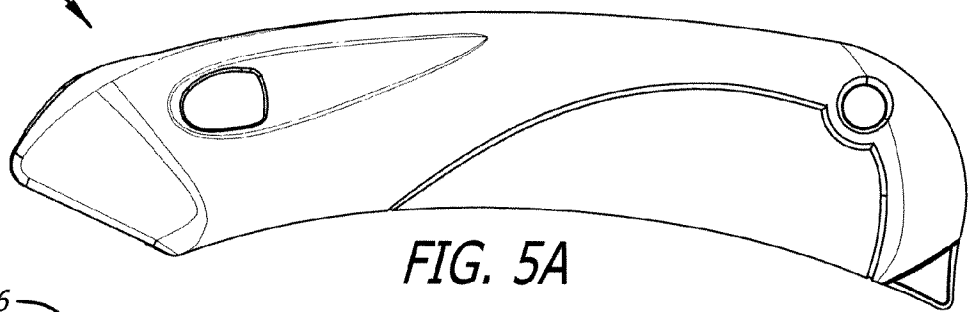
Figure 5C:
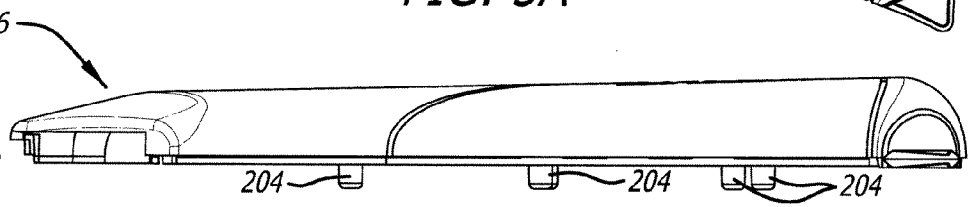
Figure 5D:
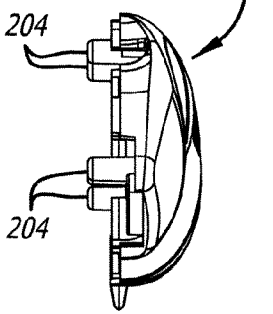
Figures 6A, 6B, 6C, 6D, 6E, 6F:
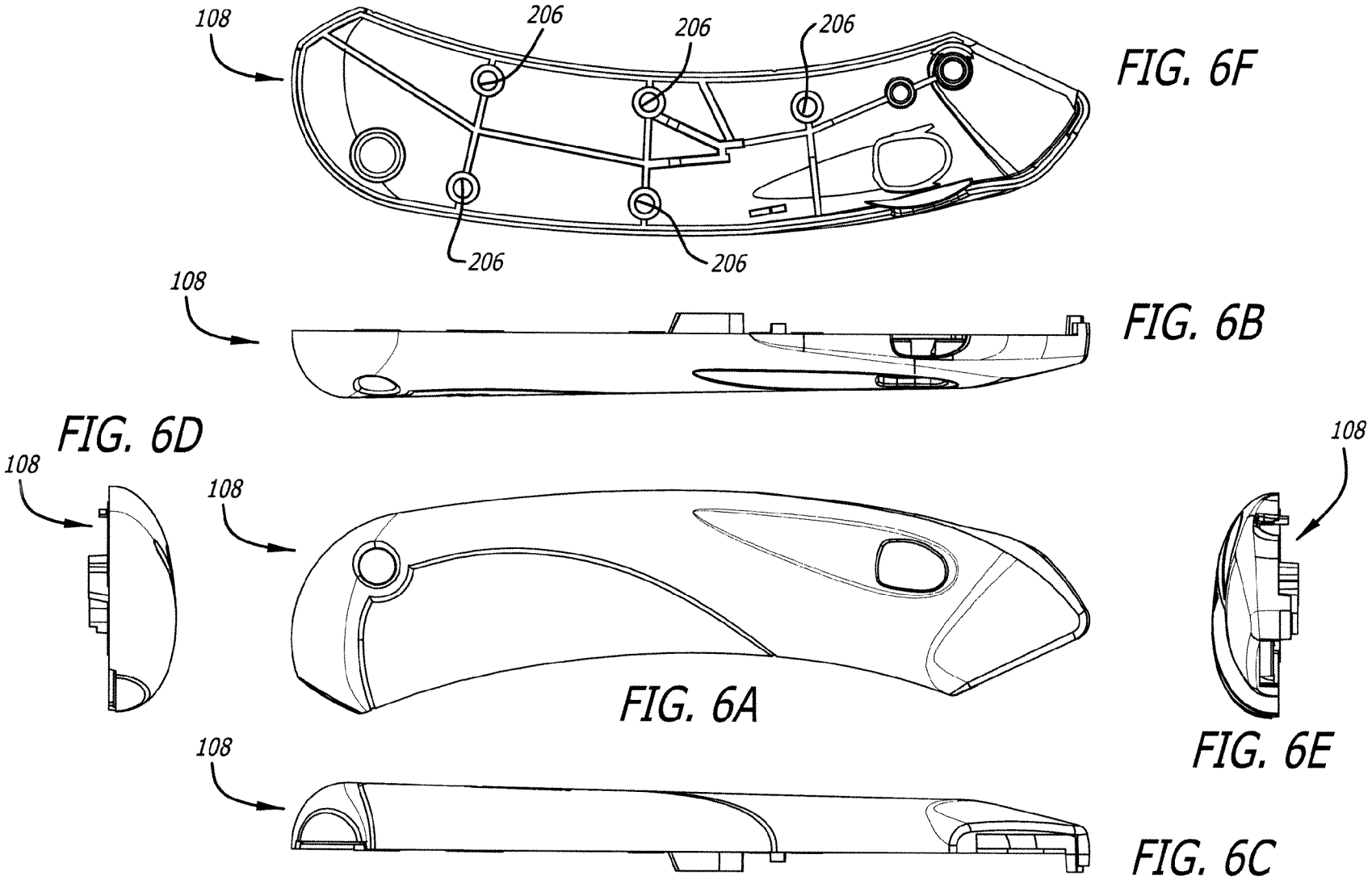
FIGS. 6A-6F are front, top, bottom, left side, right side, and back views, respectively, of the right side of the handle of FIG. 1.
Figure 9:
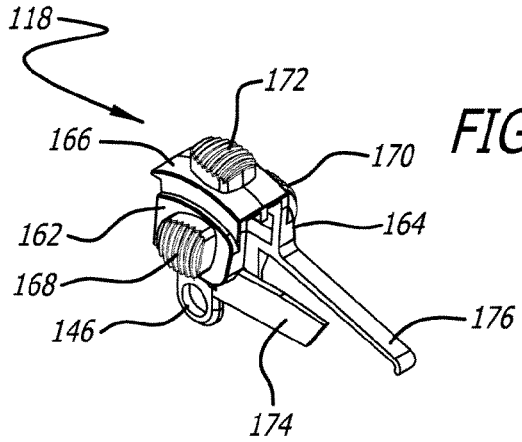
FIG. 9 is a front perspective view of the slider of FIG. 3.
Figure 9B:
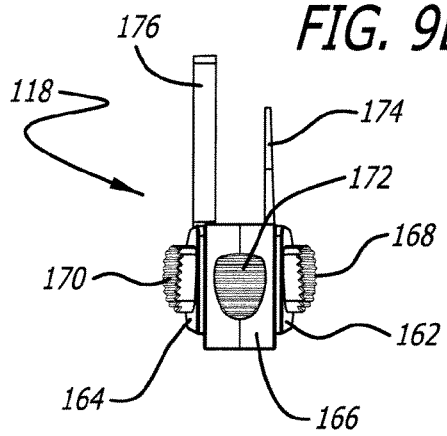
FIGS. 9A-9E are front, top, bottom, left side, and right side views, respectively, of the slider of FIG. 9.
Figure 9D:
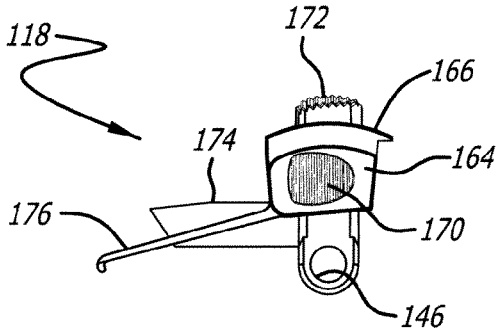
Figure 9A:
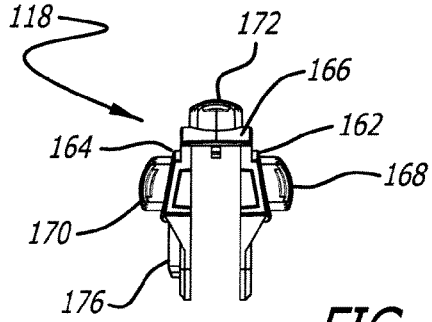
Figure 9C:
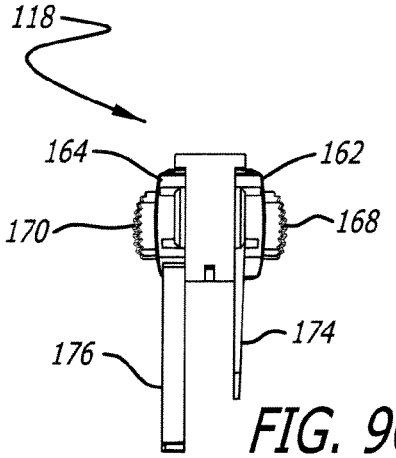
Figure 9E:
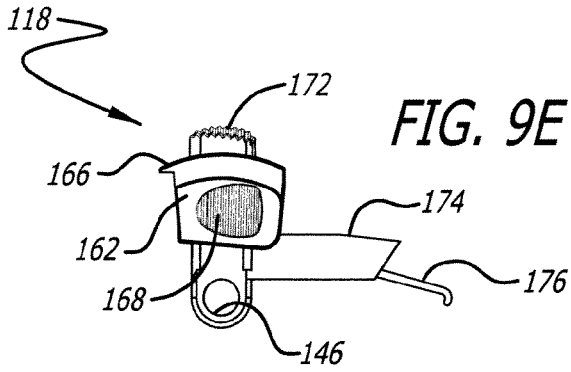
Figure 10:
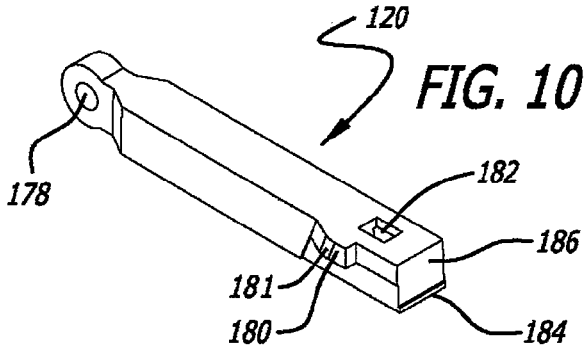
FIG. 10 is a front perspective view of the push rod of FIG. 3.
Figure 10A:
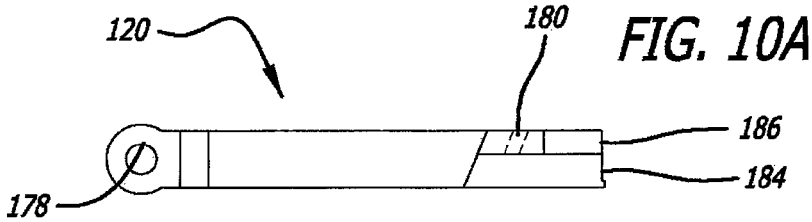
FIGS. 10A-10E are front, top, bottom, left side, and right side views, respectively, of the push rod of FIG. 10.
Figure 10B:
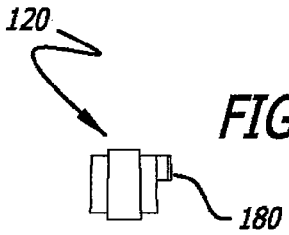
Figure 10C:
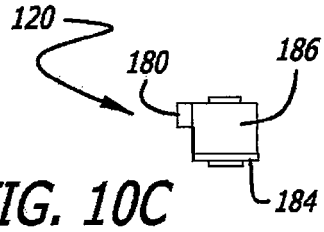
Figure 10D:
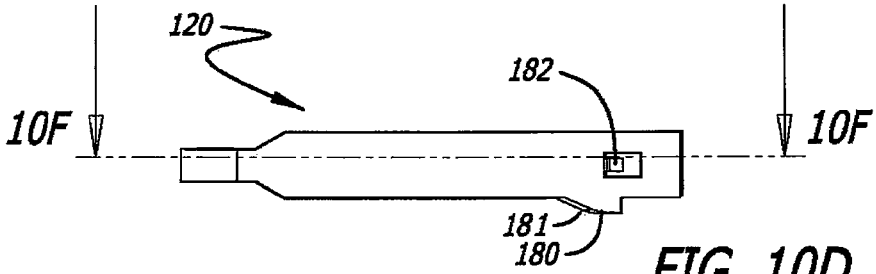
Figure 10E:
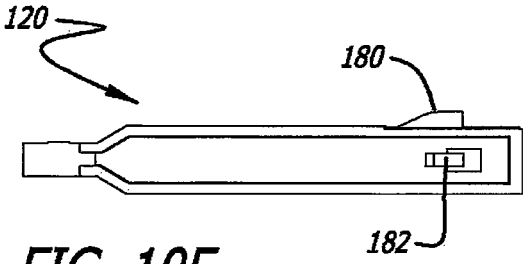
Figure 10F:
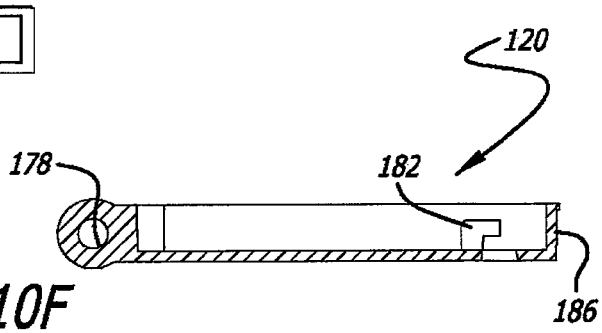
FIG. 10F is a cross-sectional view of the push rod along section A-A of FIG. 10D.

Referring to FIG. 3, in this example embodiment, the subassembly 104 includes a blade assembly 114, a blade cover 116, a slider 118, a push rod 120, a spring 122, and a shaft 124. In this example embodiment, and referring also to FIGS. 8 and 8A-8E, the blade assembly 114 includes a body portion 126 and a blade 128 which is attached to the body portion 126. In this example embodiment, the body portion 126 is formed from two parts (made, for example, from plastic) secured together on opposite sides of the blade 128. In this example embodiment, the handle 102 includes an opening 130 and guard pivots 132 positioned inside both the left side 106 and the right side 108. In an example embodiment, the blade assembly 114 is fixed in position in relation to the handle 102. In this example embodiment, the body portion 126 of the blade assembly 114 includes a top surface 134, which is complementary in shape to an inside surface 136 of the handle 102, and bearings 138 on opposite sides of the body portion 126. In this example embodiment, the body portion 126 includes an annular channel 140 around each of the bearings 138, and the annular channels 140 are sized to receive the guard pivots 132 therein on opposite sides of the subassembly 104. When attached to the handle 102, the bearings 138 are seated in the guard pivots 132 of the handle 102, and the blade assembly 114 is fixed in position (and prevented from rotating) within the handle 102 because the top surface 134 of the blade assembly 114 is positioned against the inside surface 136 of the handle 102. In this example embodiment, the body portion 126 includes bearings 142 on opposite sides thereof, and the left side 106 and the right side 108 include bearings 144. The bearings 142 and 144 are sized to fit within cylindrical channels 146 which are on opposite sides of the slider 118 as shown. In this example embodiment, the blade assembly 114 also includes a spring anchor 148 to which one end of the spring 122 is attached.

In this example embodiment, and referring also to FIGS. 7 and 7A-7E, the blade cover 116 includes cylindrical channels 150 which are on opposite sides of the blade cover 116 as shown. In this example embodiment, the blade cover 116 (made, for example, from plastic) includes a left side wall 152 and a right side wall 154 and a perimeter wall 156 which joins the side walls 152 and 154 as shown. Edges of the side walls 152 and 154 and the perimeter wall 156 define an opening boundary 158 of the blade cover 116. In this example embodiment, the blade cover 116 also includes cylindrical channels 160 on opposite sides of the blade cover 116 as shown. In this example embodiment of the subassembly 104, the cylindrical channels 150 of the blade cover 116 are sized to receive the bearings 138 of the blade assembly 114 from inside the side walls 152 and 154. In this example embodiment, the cylindrical channels 150 of the blade cover 116 are sized to receive the guard pivots 132 from opposite sides of the blade cover 116, thereby pivotally securing the blade cover 116 to the handle 102. The guard pivots 132 are, in turn, sized to receive the bearings 138. Thus, in this example embodiment, the guard pivots 132 are positioned in the annular channels 140, receive the bearings 138 (to support the subassembly 104), and pivotally support the blade cover 116 thereabout. Accordingly, the blade cover 116 is pivotally coupled to the blade assembly 114.

In this example embodiment, and referring also to FIGS. 9 and 9A-9E, the slider 118 (made, for example, from plastic) includes a left side 162, a right side 164, and a top side 166 which joins the left and right sides 162, 164 together to provide a frame structure. The previously mentioned cylindrical channels 146 are provided through the left and right sides 162,164 as shown and are sized to receive the bearings 142 for pivotally securing the slider 118 to the blade assembly 114. In this example embodiment, buttons 168, 170 and 172 are provided on the left side 162, right side 164, and top side 166, respectively. In this example embodiment, the slider 118 includes a lifter member (or lifter) 174 attached to the left side 162 as shown. In this example embodiment, the slider 118 includes a return spring 176 attached to the right side 164 as shown. As discussed below, the return spring 176 imparts a force tending to urge the slider 118 away from a position that releases the blade cover 116.

In this example embodiment, and referring also to FIGS. 10 and 10A-10F, the push rod 120 (made, for example, from plastic) is provided with a cylindrical channel 178 that is sized to receive the shaft 124. The push rod 120 is pivotally coupled to the blade cover 116 by aligning the cylindrical channel 178 (of the push rod 120) with the cylindrical channels 160 (of the blade cover 116) and inserting the shaft 124 into the channels (e.g., as shown in FIG. 2). In this example embodiment, the push rod 120 includes a lift ramp 180, a spring anchor 182, and a safety tooth 184 formed as shown. In this example embodiment, the lift ramp 180 includes a laterally extending side portion 181 configured to cooperate with the lifter 174. In an example embodiment, the push rod 120 is entirely rigid. In this example embodiment, an end portion 186 (above the safety tooth 184) of the push rod 120 is positioned adjacent to a stop 188 in the handle 102 when the blade cover 116 is in its extended position. In this example embodiment, the spring 122 is connected between the spring anchor 148 (of the blade assembly 114) and the spring anchor 182 (of the push rod 120) and serves as a mechanism for urging the blade cover 116 toward the extended position. In this example embodiment, the safety tooth 184 fits within a recess 190 in the handle when the blade cover 116 is in the extended position and pressure is applied to the blade cover 116 thereby preventing the lifter member 174 from lifting the push rod 120.

In this example embodiment, and referring also to FIGS. 4A-4E, the slider 118 (pivotally coupled to the blade assembly 114) is repositionable along the handle 102 to release the blade cover 116 from the extended position. In this example embodiment, the handle 102 is provided with apertures 192, 194, and 196 through which the buttons 168, 170 and 172 extend, respectively. In this example embodiment, the handle 102 includes indented portions 198, 200, and 202 adjacent apertures 192, 194, and 196, respectively, which provide ergonomic angles of approach for pushing the buttons 168, 170 and 172 forward (i.e., away from the indented portions 198, 200, and 202). In an example embodiment, the slider 118 includes one or more buttons that extend through the handle 102, at least one of the buttons extending through a top side of the handle 102 opposite the blade cutting edge of the blade assembly 114.

In this example embodiment, and referring also to FIGS. 5A-5F and 6A-6F, the left side 106 and the right side 108 include complementary interfitting elements 204 and 206, respectively, which are snap-fitted together and/or secured together with an adhesive.

Figure 11:
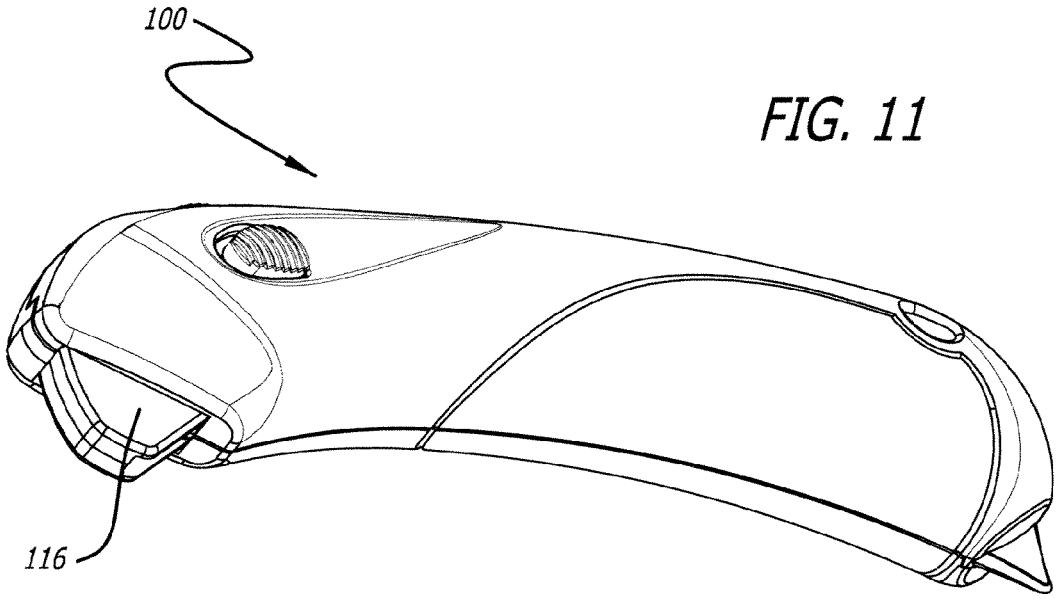
FIG. 11 is a front perspective view of the utility knife of FIG. 1 with its blade cover shown in an extended position.
Figure 12:
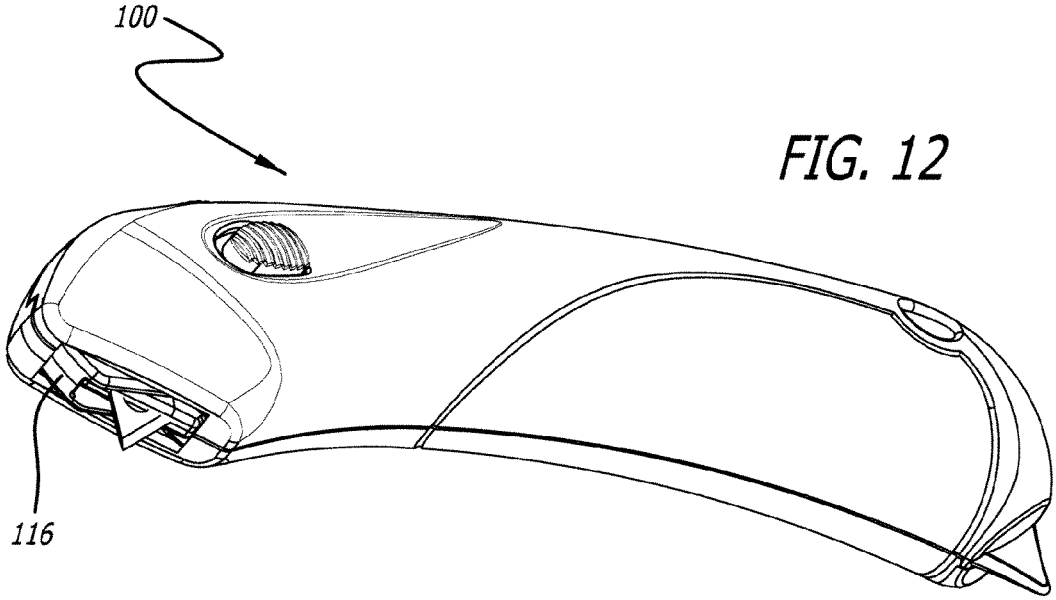
FIG. 12 is a front perspective view of the utility knife of FIG. 1 with its blade cover shown in a retracted position.
Figure 13:
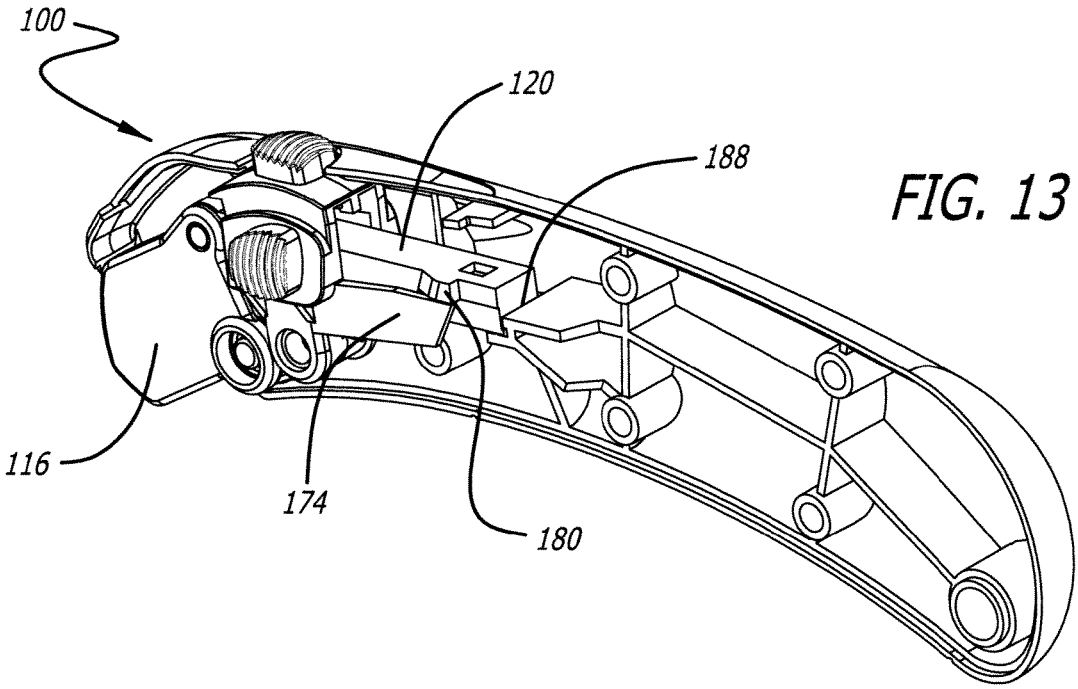
FIG. 13 is a front perspective view of the utility knife of FIG. 1 (shown with the left side of the handle removed), with the push rod positioned against a stop which locks the blade guard in its extended position.

FIGS. 11 and 12 show the utility knife 100 with the blade cover 116 in an extended position and a retracted position, respectively. FIGS. 13-18 show the utility knife 100 in operation (with the left side 106 and return spring 176 removed to better show the working components). In FIG. 13, the utility knife 100 is shown "at rest" with the push rod 120 positioned against the stop 188 which locks the blade guard 116 in its extended position. Also in FIG. 13, the lifter 174 is positioned beneath the lift ramp 180 as shown. In an example embodiment, the blade cover 116 is mechanically coupled to the handle 102 facilitating manipulability of the blade cover 116 to an extended position over the blade assembly 114. In an example embodiment, the utility knife 100 includes a slider mechanism that is mechanically coupled to the push rod 120 and movable in relation to the housing 102 such that the push rod 120 is allowed to move within the handle 102 to facilitate locking the blade cover 116 in an extended position over the blade assembly 114 and unlocking the blade cover 116 from the extended position. In an example embodiment, the slider mechanism includes a lifter member that bears against the push rod when the slider is moved into a position that releases the blade cover. In an example embodiment, the slider mechanism includes a lifter member for releasing the blade cover from the extended position by repositioning the push rod in relation to a portion of the handle. In an example embodiment, the portion of the handle is a stop. In an example embodiment, the utility knife further includes one or more buttons that are connected to the lifter member and repositionable along the handle to pivot the lifter member.

In an example embodiment, the lifter member 174 is pivotally movable within the handle 102 (e.g., pivotally coupled to the blade assembly 114) to engage with and reposition the push rod 120 in relation to the stop 188 such that the blade cover 116 is released from the extended position. In an example embodiment, the slider 118 is configured to manipulate the push rod 120 in relation to the stop 188.

Figure 14:
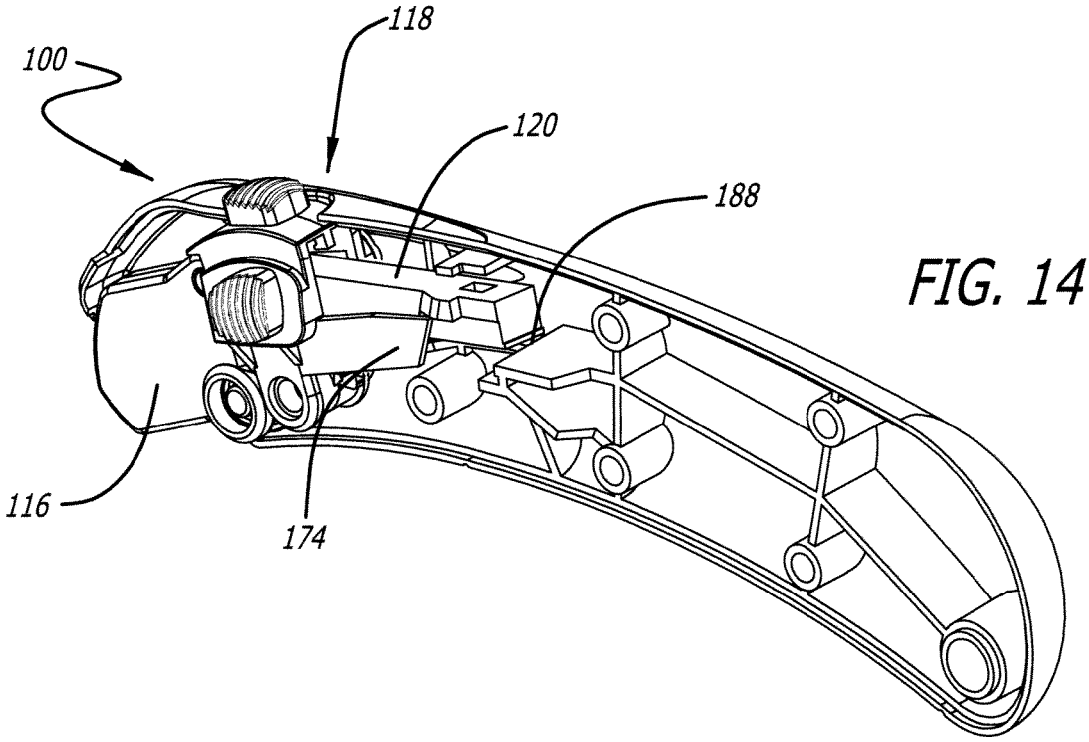
FIG. 14 is the view of FIG. 13, showing the slider pushed forward which causes the lifter to raise the push rod to unlock the blade guard.
Figure 15:
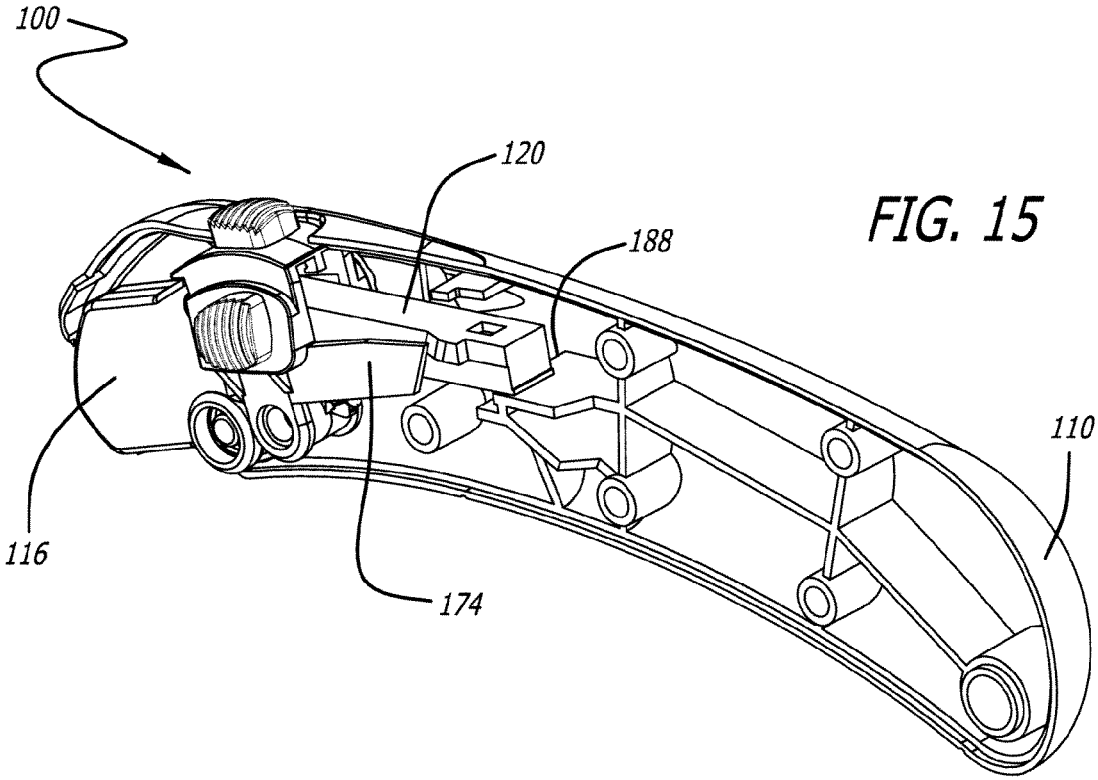
FIG. 15 is the view of FIG. 13, showing the blade guard partially retracted.
Figure 16:
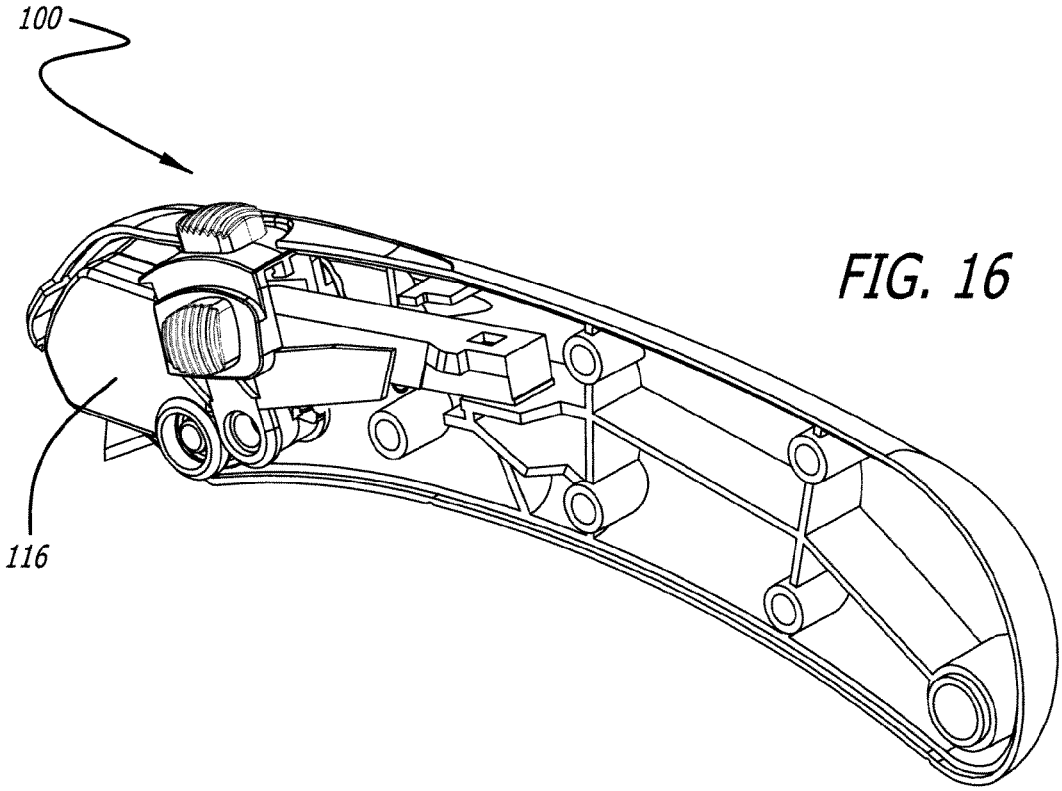
FIG. 16 is the view of FIG. 13, showing the blade guard fully retracted.
Figure 17:
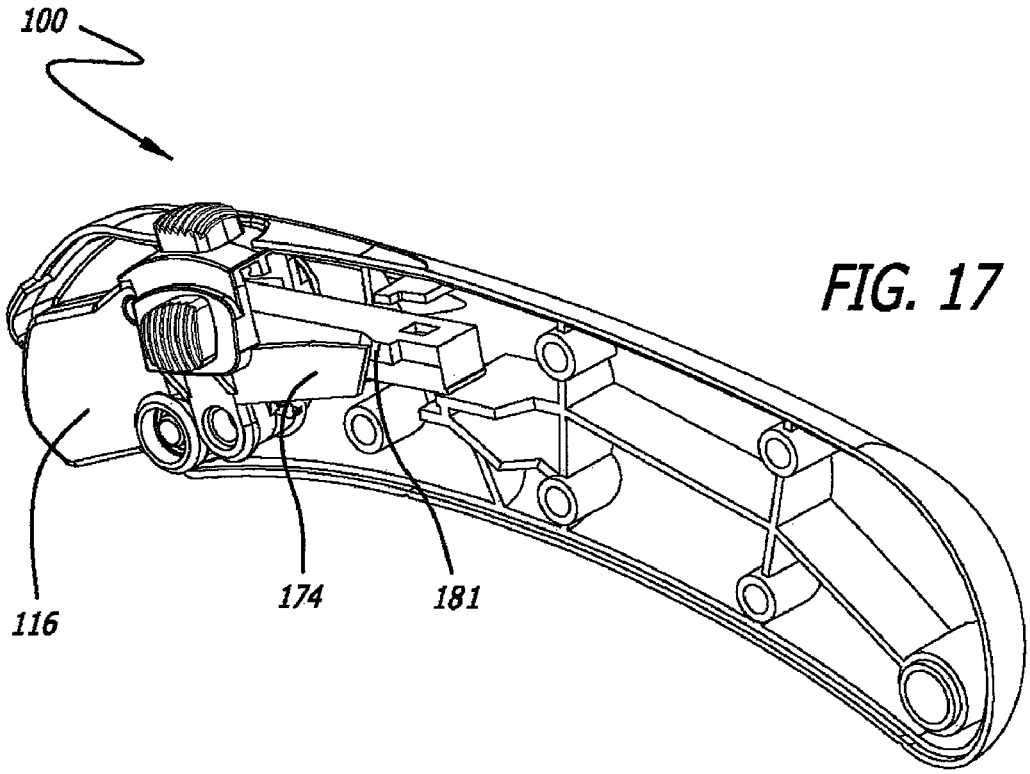
FIG. 17 is the view of FIG. 13, showing the blade guard returning to its extended position.
Figure 18:
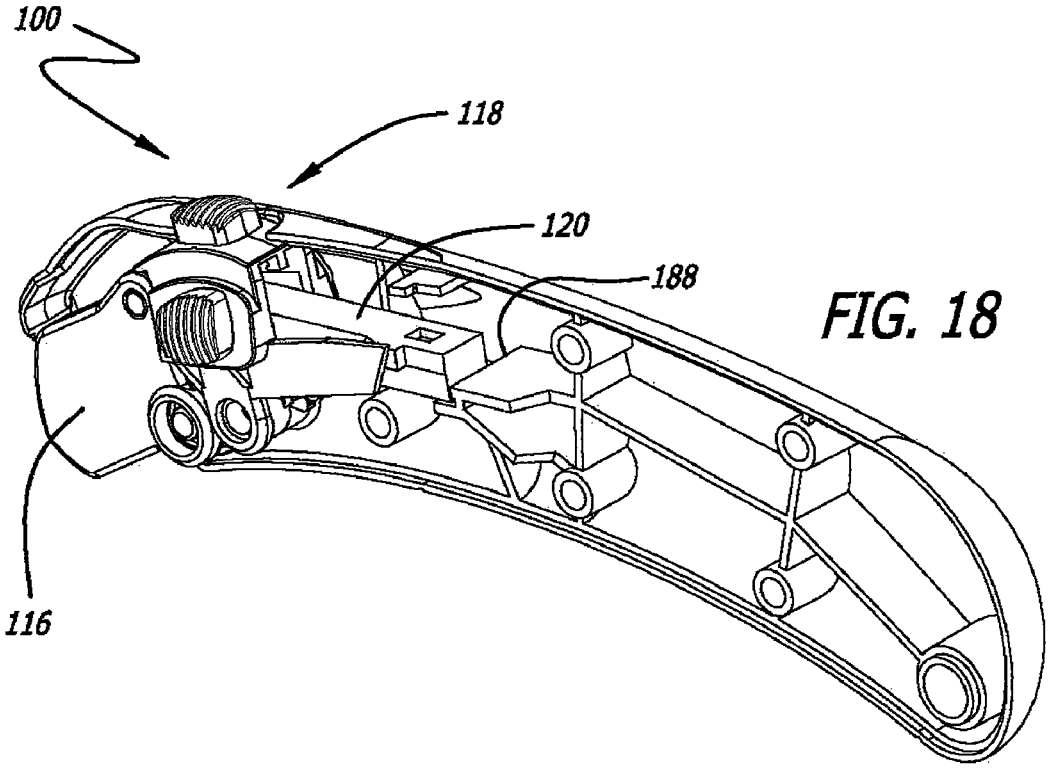
FIG. 18 is the view of FIG. 13, showing the blade guard locked again in its extended position when the push rod drops behind the stop (a locking motion that is independent of the position of the slider).

In FIG. 14, the slider 118 is shown pushed forward which causes the lifter 174 to raise the push rod 120 to unlock the blade guard 116. In FIG. 15, the blade guard 116 is shown partially retracted, with the push rod 120 having been lifted above the stop 188. This in turn permits the retracting motion of the blade guard 116 to force the push rod 120 past the stop 188 toward the base portion 110 of the handle 102. In FIG. 16, the blade guard 116 is shown fully retracted. In FIG. 17, the blade guard 116 is shown returning to its extended position. Once contact between a work surface (not shown) and the blade guard 116 is removed, the spring 122 urges the push rod 120 toward the blade guard 116 which moves the blade guard 116 back toward its extended position with the lifter 174 deflecting sideways as shown in cooperation with the laterally extending side portion 181 of the lift ramp 180. In FIG. 18, the blade guard 116 is shown locked again in its extended position when the push rod 120 drops behind the stop 188 (a locking motion that is independent of the position of the slider 118).

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A utility knife comprising:

a handle;

a blade assembly secured to the handle;

a blade cover mechanically coupled to the handle facilitating manipulability of the blade cover to an extended position over the blade assembly; and a slider that is repositionable along the handle to release the blade cover from the extended position, the slider being pivotally coupled to the blade assembly;

wherein the slider includes three buttons that extend through the handle.

2. The utility knife of claim 1, wherein the blade cover is pivotally coupled to the blade assembly.

3. The utility knife of claim 1, wherein at least one of the three buttons extends through a top side of the handle opposite a blade cutting edge of the blade assembly.

4. The utility knife of claim 1, further including:

a mechanism for urging the blade cover toward the extended position.

5. The utility knife of claim 4, wherein the mechanism includes a spring.

6. The utility knife of claim 1, further including:

a push rod that is mechanically coupled to the blade cover; and a stop inside the handle;

wherein the slider is configured to manipulate the push rod in relation to the stop.

7. The utility knife of claim 6, wherein the slider mechanism includes a lifter member that bears against the push rod when the slider is moved into a position that releases the blade cover.

8. The utility knife of claim 7, wherein the slider includes a return spring that imparts a force tending to urge the slider away from the position that releases the blade cover.

9. A utility knife comprising:

a handle;

a blade assembly secured to the handle;

a blade cover mechanically coupled to the handle facilitating manipulability of the blade cover to an extended position over the blade assembly;

a stop in the handle;

a push rod that is mechanically coupled to the blade cover and configured to facilitate positioning of the push rod adjacent to the stop when the blade cover is in the extended position;

a lifter member that is pivotally movable within the handle to engage with and reposition the push rod in relation to the stop to release the blade cover from the extended position; and three buttons that are connected to the lifter member and repositionable along the handle to pivot the lifter member.

10. The utility knife of claim 9, wherein the blade cover is pivotally coupled to blade assembly.

11. The utility knife of claim 9, wherein the lifter member is pivotally coupled to the blade assembly.

12. The utility knife of claim 9, wherein the push rod includes a safety tooth that fits within a recess in the handle when the blade cover is in the extended position and pressure is applied to the blade cover thereby preventing the lifter member from lifting the push rod.

13. The utility knife of claim 9, wherein the push rod is entirely rigid.

14. The utility knife of claim 9, further including:

a spring connected between the blade assembly and the push rod.

15. The utility knife of claim 9, wherein one of the three buttons extends through a top side of the handle opposite a blade cutting edge of the blade assembly.

16. A utility knife comprising:

a handle;

a blade assembly secured to the handle;

a blade cover mechanically coupled to the handle;

a push rod inside the handle;

a slider mechanism mechanically coupled to the push rod, the slider mechanism being movable in relation to the housing allowing the push rod to move within the handle to facilitate locking the blade cover in an extended position over the blade assembly and unlocking the blade cover from the extended position; and a spring configured to urge the blade cover toward the extended position;

wherein the slider mechanism includes three buttons that extend through the handle.

17. The utility knife of claim 16, wherein the push rod is entirely rigid.

18. The utility knife of claim 16, wherein the spring is connected to the push rod.

19. The utility knife of claim 16, wherein the spring is connected between the push rod and the blade assembly.

20. The utility knife of claim 16, wherein the blade cover is pivotally connected to the blade assembly.

21. The utility knife of claim 16, wherein the slider mechanism is pivotally connected to the blade assembly.

22. The utility knife of claim 16, wherein the slider mechanism includes a lifter member for releasing the blade cover from the extended position by repositioning the push rod in relation to a portion of the handle.

23. The utility knife of claim 22, wherein the portion of the handle is a stop.

24. The utility knife of claim 16, wherein the slider mechanism includes a return spring biased to urge the slider mechanism away from a slider position that releases the blade cover from the extended position.

25. The utility knife of claim 16, wherein one of the three buttons extends through a top side of the handle opposite a blade cutting edge of the blade assembly.

26. A utility knife comprising:

a handle;

a blade assembly secured to the handle and including a blade;

a blade cover mechanically coupled to the handle;

a stop in the handle;

a push rod that is mechanically coupled to the blade cover and positionable adjacent to the stop when the blade cover is in an extended position over the blade, the push rod including a lift ramp; and an actuator that extends through the handle, the actuator being repositionable in relation to the handle to release the blade cover from the extended position, the actuator including a lifter that bears against the lift ramp repositioning the push rod in relation to the stop when the actuator is moved into a position that releases the blade cover.

27. A utility knife comprising:

a handle;

a blade assembly secured to the handle and including a blade;

a blade cover mechanically coupled to the handle;

a stop in the handle;

a push rod that is mechanically coupled to the blade cover and positionable adjacent to the stop when the blade cover is in an extended position over the blade, the push rod including a tab; and an actuator that extends through the handle, the actuator being repositionable in relation to the handle to release the blade cover from the extended position, the actuator including a displacement arm configured to cooperate with the tab for repositioning the push rod in relation to the stop when the actuator is moved into a position that releases the blade cover.

28. A utility knife comprising:

a handle;

a blade assembly secured to the handle and including a blade;

a blade cover mechanically coupled to the handle;

a stop in the handle;

a locking member that is mechanically coupled to the blade cover and positionable adjacent to the stop when the blade cover is in an extended position; and a lifter for repositioning the locking member in relation to the stop to release the blade cover from the extended position;

wherein the locking member includes a lift ramp configured to cooperate with the lifter when the locking member is moved into a position that releases the blade cover from the extended position as well as to permit the lifter to return to an initial position even when the locking member is in a locked position preventing the blade cover from moving from the extended position.

29. The utility knife of claim 28, wherein the lift ramp includes a laterally extending side portion configured to cooperate with the lifter.

30. The utility knife of claim 28, further including:

a spring configured to urge the blade cover to the extended position, the spring being attached to the locking member and configured to urge the locking member toward the blade guard.

31. The utility knife of claim 30, wherein the spring is attached to an underside of the locking member, facing a bottom side of the handle.

32. The utility knife of claim 30, wherein the lifter is configured to deflect sideways against the lift ramp when the spring returns the blade guard to the extended position.

33. The utility knife of claim 28, further including:

a plurality of actuators connected to the lifter and repositionable in relation to the handle to reposition the lifter.

34. The utility knife of claim 33, wherein one of the actuators extends through a top side of the handle opposite a blade cutting edge of the blade assembly.

35. The utility knife of claim 28, wherein the blade cover is pivotally coupled to blade assembly.

36. The utility knife of claim 28, wherein the lifter is pivotally coupled to the blade assembly.

37. The utility knife of claim 28, wherein the locking member includes a safety tooth that fits within a recess in the handle when the blade cover is in the extended position and pressure is applied to the blade cover thereby preventing the lifter from lifting the locking member.

38. The utility knife of claim 28, wherein the locking member is entirely rigid.

39. The utility knife of claim 30, wherein the spring is connected between the blade assembly and the locking member.

* * * * *

UNITED STATES PATENT AND TRADEMARK OFFICE

CERTIFICATE OF CORRECTION

PATENT NO. : 7,774,942 C2
APPLICATION NO. : 90/011851
DATED : March 27, 2012
INVENTOR(S) : G. Gerry Schmidt It is certified that error appears in the above-identified patent and that said Letters Patent is hereby corrected as shown below:

Title Page, below Item (54)

"(75) Inventor: G. Gerry Schmidt, Newport Beach, CA (US)"

should read

--(75) Inventors: G. Gerry Schmidt, Newport Beach, CA (US); John Andrew Duval, Long Beach, CA (US)--.

Signed and Sealed this
Twenty-fifth Day of February, 2014

Michelle K. Lee

Michelle K. Lee
*Deputy Director of the United States Patent and Trademark Office*

US007774942C1

(12) EX PARTE REEXAMINATION CERTIFICATE (8544th)

United States Patent

Schmidt

(10) Number: US 7,774,942 C1

(45) Certificate Issued: Sep. 13, 2011

(54) UTILITY KNIFE

(75) Inventor: G. Gerry Schmidt, Newport Beach, CA (US)

(73) Assignee: American Capital Financial Services, Inc., Bethesda, MD (US)

Reexamination Request:
No. 90/011,159, Aug. 17, 2010

Reexamination Certificate for:

| | |
|---|---|
| Patent No.: | **7,774,942** |
| Issued: | **Aug. 17, 2010** |
| Appl. No.: | **11/539,839** |
| Filed: | **Oct. 9, 2006** |

(51) Int. Cl.
*B26B 1/08* (2006.01)

(52) U.S. Cl. ..... 30/162; 30/286; 30/342; 30/335

(58) Field of Classification Search ..... 30/162
See application file for complete search history.

(56) References Cited

U.S. PATENT DOCUMENTS

| | | | |
|---|---|---|---|
| 4,931,042 | A | 6/1990 | Holmes et al. |
| 5,366,445 | A | 11/1994 | Haber et al. |
| 6,718,640 | B1 | 4/2004 | John |
| 2002/0124412 | A1 | 9/2002 | Votolato |
| 2002/0124418 | A1 | 9/2002 | Votolato |
| 2005/0217114 | A1 | 10/2005 | Votolato |

FOREIGN PATENT DOCUMENTS

| | | | |
|---|---|---|---|
| EP | 0252711 | A1 | 1/1988 |

OTHER PUBLICATIONS

Third–Amended Complaint for Patent Infringement—*Spellbound Development Group Inc* v. *Pacific Handy Cutter Inc et al*, Civil Action No. SACV09–00951 DOC (ANx), Sep. 1, 2010, USDC, Central Division of California, Southern Division.

Answer of Pacific Handy Cutter, Inc. to Third–Amended Complaint for Patent Infringement—*Spellbound Development Group Inc.* v. *Pacific Handy Cutter Inc et al*, Civil Action No. SACV09–00951 DOC (ANx), Sep. 15, 2010, USDC, Central Division of California, Southern Division.

*Primary Examiner*—Jeffrey L. Gellner

(57) ABSTRACT

A utility knife includes a handle, a blade assembly secured to the handle, a blade cover mechanically coupled to the handle facilitating manipulability of the blade cover to an extended position over the blade assembly, and a slider that is repositionable along the handle to release the blade cover from the extended position, the slider being pivotally coupled to the blade assembly.

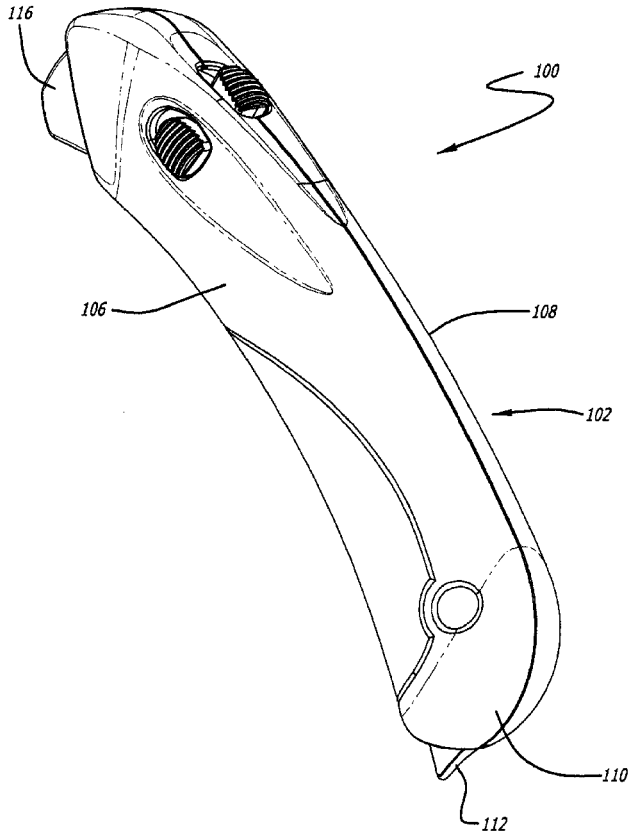

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 27 is cancelled.

Claims 26, 28, 30 and 35 are determined to be patentable as amended.

Claims 29, 31-34 and 36-39, dependent on an amended claim, are determined to be patentable.

New claims 40-63 are added and determined to be patentable.

Claims 1-25 were not reexamined.

26. A utility knife comprising:

a handle;

a blade assembly secured to the handle and including a blade;

a blade cover mechanically coupled to the handle;

a stop in the handle;

a push rod that is mechanically coupled to the blade cover and positionable adjacent to the stop when the blade cover is in an extended position over the blade, the push rod including a lift ramp; and an actuator that extends through the handle, the actuator being repositionable in relation to the handle to release the blade cover from the extended position, the actuator including a lifter that bears against the lift ramp repositioning the push rod in relation to the stop when the actuator is moved into a position that releases the blade cover*;*

*wherein the blade cover is pivotally coupled to the blade assembly*.

28. A utility knife comprising:

a handle;

a blade assembly secured to the handle aned including a blade;

a blade cover mechanically coupled to the handle;

a stop in the handle;

a locking member that is mechanically coupled to the blade cover and positionable adjacent to the stop when the blade cover is in an extended position; and a lifter for repositioning the locking member in relation to the stop to release the blade cover from the extended position;

wherein the locking member includes a lift ramp configured to cooperate with the lifter when the locking member is moved into a position that releases the blade cover from the extended position as well as to permit the lifter to return to an inital position even when the locking member is in a locked position preventing the blade cover from moving from the extended position*;*

*wherein the blade cover is pivotally coupled to the blade assembly*.

30. The utility knife of claim 28, further including:

a spring configured to urge the blade cover to the extended position, the spring being attached to the locking member and configured to urge the locking member toward the blade [guard] *cover*.

35. The utility knife of claim [28] *61*, wherein the blade cover is pivotally coupled to *the* blade assembly.

*40. The utility knife of claim 28, wherein the blade assembly is fixed in position within the handle.*

*41. The utility knife of claim 28, wherein the blade assembly includes a body portion formed from two parts secured together on opposite sides of the blade.*

*42. The utility knife of claim 28, wherein the blade assembly includes a body portion secured to the blade.*

*43. The utility knife of claim 42, wherein the body portion includes two parts secured together on opposite sides of the blade.*

*44. The utility knife of claim 26, wherein the lift ramp includes a laterally extending side portion configured to cooperate with the lifter.*

*45. The utility knife of claim 26, further including:*

*a spring configured to urge the blade cover to the extended position, the spring being attached to the push rod and configured to urge the push rod toward the blade cover.*

*46. The utility knife of claim 45, wherein the spring is attached to an underside of the push rod, facing a bottom side of the handle.*

*47. The utility knife of claim 45, wherein the lifter is configured to deflect sideways against the lift ramp when the spring returns the blade guard to the extended position.*

*48. The utility knife of claim 57, wherein the blade cover is pivotally coupled to the blade assembly.*

*49. The utility knife of claim 26, wherein the lifter is pivotally coupled to the blade assembly.*

*50. The utility knife of claim 26, wherein the push rod includes a safety tooth that fits within a recess in the handle when the blade cover is in the extended position and pressure is applied to the blade cover thereby preventing the lifter form lifting the push rod.*

*51. The utility knife of claim 26, wherein the push rod is entirely rigid.*

*52. The utility knife of claim 45, wherein the spring is connected between the blade assembly and the push rod.*

*53. The utility knife of claim 26, wherein the blade assembly is fixed in position within the handle.*

*54. The utility knife of claim 26, wherein the blade assembly includes a body portion formed from two parts secured together on opposite sides of the blade.*

*55. The utility knife of claim 26, wherein the blade assembly includes a body portion secured to the blade.*

*56. The utility knife of claim 55, wherein the body portion includes two parts secured together on opposite sides of the blade.*

*57. A utility knife comprising:*

*a handle;*

*a blade assembly secured to the handle and including a blade;*

*a blade cover mechanically coupled to the handle;*

*a stop in the handle;*

*a push rod that is mechanically coupled to the blade cover and positionable adjacent to the stop when the blade*

*cover is in an extended position over the blade, the push rod including a lift ramp; and*

*an actuator that extends through the handle, the actuator being repositionable in relation to the handle to release the blade cover from the extended position, the actuator including a lifter that bears against the lift ramp repositioning the push rod in relation to the stop when the actuator is moved into a position that releases the blade cover;*

*wherein the lifter is pivotally coupled to the blade assembly.*

*58. A utility knife comprising:*

*a handle;*

*a blade assembly secured to the handle and including a blade;*

*a blade cover mechanically coupled to the handle;*

*a stop in the handle;*

*a push rod that is mechanically coupled to the blade cover and positionable adjacent to the stop when the blade cover is in an extended position over the blade, the push rod including a lift ramp; and*

*an actuator that extends through the handle, the actuator being repositionable in relation to the handle to release the blade cover from the extended position, the actuator including a lifter that bears against the lift ramp repositioning the push rod in relation to the stop when the actuator is moved into a position that releases the blade cover;*

*wherein the push rod includes a safety tooth that fits within a recess in the handle when the blade cover is in the extended position and pressure is applied to the blade cover thereby preventing the lifter from lifting the push rod.*

*59. A utility knife comprising:*

*a handle;*

*a blade assembly secured to the handle and including a blade;*

*a blade cover mechanically coupled to the handle;*

*a stop in the handle;*

*a push rod that is mechanically coupled to the blade cover and positionable adjacent to the stop when the blade cover is in an extended position over the blade, the push rod including a lift ramp;*

*an actuator that extends through the handle, the actuator being respositionable in relation to the handle to release the blade cover from the extended position, the actuator including a lifter that bears against the lift ramp repositioning the push rod in relation to the stop when the actuator is moved into a position that releases the blade cover; and*

*a spring configured to urge the blade cover to the extended position, the spring being attached to the push rod and configured to urge the push rod toward the blade cover;*

*wherein the spring is connected between the blade assembly and the push rod.*

*60. A utility knife comprising:*

*a handle;*

*a blade assembly secured to the handle and including a blade;*

*a blade cover mechanically coupled to the handle;*

*a stop in the handle;*

*a locking member that is mechanically coupled to the blade cover and positionable adjacent to the stop when the blade cover is in an extended position;*

*a lifter for repositioning the locking member in relation to the stop to release the blade cover from the extended position; and*

*a plurality of actuators connected to the lifter and repositionable in relation to the handle to reposition the lifter;*

*wherein the locking member includes a lift ramp configured to cooperate with the lifter when the locking member is moved into a position that releases the blade cover from the extended position as well as to permit the lifter to return to an initial position even when the locking member is in a locked position preventing the blade cover from moving from the extended position.*

*61. A utility knife comprising:*

*a handle;*

*a blade assembly secured to the handle and including a blade;*

*a blade cover mechanically coupled to the handle;*

*a stop in the handle;*

*a locking member that is mechanically coupled to the blade cover and positionable adjacent to the stop when the blade cover is in an extended position; and*

*a lifter for repositioning the locking member in relation to the stop to release the blade cover from the extended position;*

*wherein the locking member includes a lift ramp configured to cooperate with the lifter when the locking member is moved into a position that releases the blade cover from the extended position as well as to permit the lifter to return to an initial position even when the locking member is in a locked position preventing the blade cover from moving from the extended position;*

*wherein the lifter is pivotally coupled to the blade assembly.*

*62. A utility knife comprising:*

*a handle;*

*a blade assembly secured to the handle and including a blade;*

*a blade cover mechanically coupled to the handle;*

*a stop in the handle;*

*a locking member that is mechanically coupled to the blade cover and positionable adjacent to the stop when the blade cover is in an extended position; and*

*a lifter for repositioning the locking member in relation to the stop to release the blade cover from the extended position;*

*wherein the locking member includes a lift ramp configured to cooperate with the lifter when the locking member is moved into a position that releases the blade cover from the extended position as well as to permit the lifter to return to an initial position even when the locking member is in a locked position preventing the blade cover from moving from the extended position;*

*wherein the locking member includes a safety tooth that fits within a recess in the handle when the blade cover is in the extended position and pressure is applied to the blade cover thereby preventing the lifter from lifting the locking member.*

*63. A utility knife comprising:*

*a handle;*

*a blade assembly secured to the handle and including a blade;*

*a blade cover mechanically coupled to the handle;*

*a stop in the handle;*

*a locking member that is mechanically coupled to the blade cover and positionable adjacent to the stop when the blade cover is in an extended position;*

*a lifter for repositioning the locking member in relation to the stop to release the blade cover from the extended position; and*

*a spring configured to urge the blade cover to the extended position, the spring being attached to the locking member and configured to urge the locking member toward the blade cover;*

*wherein the locking member includes a lift ramp configured to cooperate with the lifter when the locking member is moved into a position that releases the blade cover from the extended position as well as to permit the lifter to return to an initial position even when the locking member is in a locked position preventing the blade cover from moving from the extended position;*

*wherein the spring is connected between the blade assembly and the locking member.*

* * * * *

US007774942C2

(12) EX PARTE REEXAMINATION CERTIFICATE (8937th)

United States Patent
Schmidt

(10) Number: US 7,774,942 C2
(45) Certificate Issued: Mar. 27, 2012

(54) UTILITY KNIFE

(75) Inventor: G. Gerry Schmidt, Newport Beach, CA (US)

(73) Assignee: Pacific Handy Cutter, Inc., Costa Mesa, CA (US)

Reexamination Request:
No. 90/011,851, Aug. 9, 2011

Reexamination Certificate for:

| | |
|---|---|
| Patent No.: | **7,774,942** |
| Issued: | **Aug. 17, 2010** |
| Appl. No.: | **11/539,839** |
| Filed: | **Oct. 9, 2006** |

Reexamination Certificate C1 7,774,942 issued Sep. 13, 2011

(51) Int. Cl.
*B26B 1/08* (2006.01)

(52) U.S. Cl. ..... 30/162; 30/286; 30/335; 30/342

(58) Field of Classification Search ..... None
See application file for complete search history.

(56) References Cited

To view the complete listing of prior art documents cited during the proceeding for Reexamination Control Number 90/011,851, please refer to the USPTO's public Patent Application Information Retrieval (PAIR) system under the Display References tab.

*Primary Examiner*—Russell Stormer

(57) ABSTRACT

A utility knife includes a handle, a blade assembly secured to the handle, a blade cover mechanically coupled to the handle facilitating manipulability of the blade cover to an extended position over the blade assembly, and a slider that is repositionable along the handle to release the blade cover from the extended position, the slider being pivotally coupled to the blade assembly.

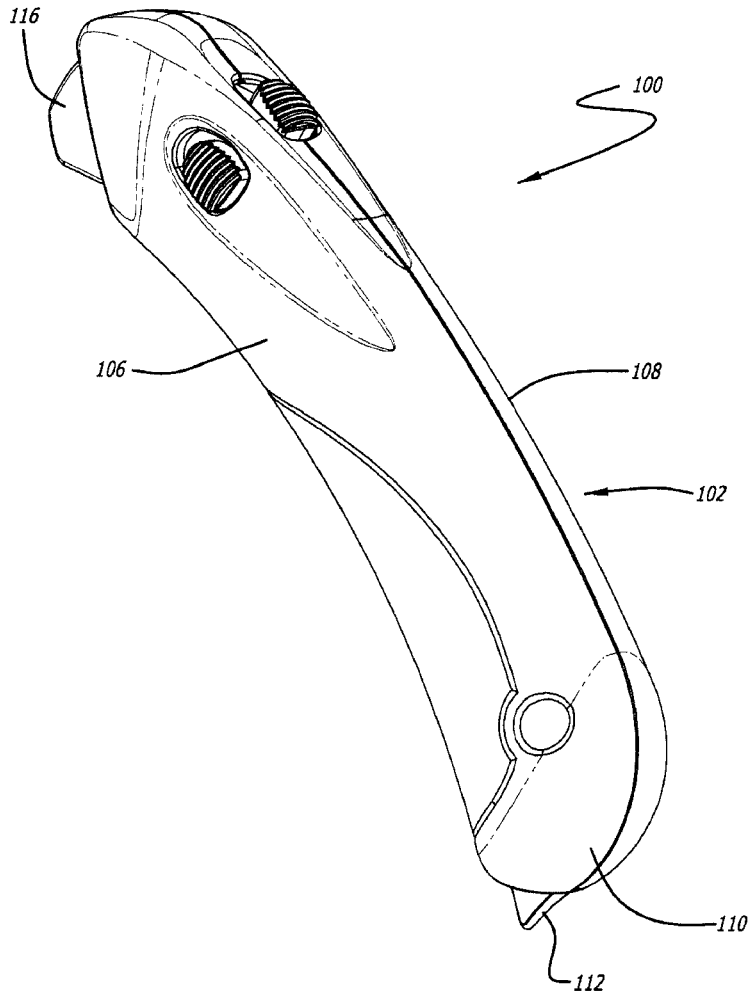

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 26, 28-32, 38-47 and 51 is confirmed.

Claim 27 was previously cancelled.

Claims 1-25, 33-37, 48-50 and 52-63 were not reexamined.

* * * * *